US006264113B1

(12) United States Patent
Dingler

(10) Patent No.: US 6,264,113 B1
(45) Date of Patent: Jul. 24, 2001

(54) FLUID SPRAYING SYSTEM

(75) Inventor: Douglas W. Dingler, Kentwood, MI (US)

(73) Assignee: Steelcase Inc., Grand Rapids, MI (US)

( * ) Notice: Subject to any disclaimer, the term of this patent is extended or adjusted under 35 U.S.C. 154(b) by 0 days.

(21) Appl. No.: 09/356,149

(22) Filed: Jul. 19, 1999

(51) Int. Cl.[7] ..... B05B 17/00; B05B 1/28

(52) U.S. Cl. ..... 239/8; 239/8; 239/11; 239/67; 239/69; 239/290; 239/296

(58) Field of Search ..... 239/67, 69, 70, 239/106, 290, 296, 8, 11

(56) References Cited

U.S. PATENT DOCUMENTS

| | | | |
|---|---|---|---|
| 2,255,189 | 9/1941 | Robinson et al. | 91/45 |
| 2,335,116 | 11/1943 | Hansen | 91/45 |
| 2,739,843 | 3/1956 | Baur | 299/140.1 |

(List continued on next page.)

OTHER PUBLICATIONS

Promotional material for "MSV–2K Pro Bond 2K™Waterborne Adhesive", Service Bulletin SB–2–550–A, by Fact Inc., bearing a designation "©Copyright 1995", 11 sheets.

Promotional material for "Binks Mach 1PC HVLP Spray Gun", by Fact Inc., bearing a designation "©Copyright 1995", 8 sheets.

Promotional material for "Optimiser 2K™ HVLP Two Component Adhesive Spray Gun", by Fact Inc. bearing a designation of "©Copyright 1993", 29 sheets.

(List continued on next page.)

*Primary Examiner*—David A. Scherbel
*Assistant Examiner*—Robin O. Evans

(74) *Attorney, Agent, or Firm*—Foley & Lardner

(57) ABSTRACT

A spraying system for delivering a plurality of fluids for applying to a surface is disclosed. The spraying system includes a nozzle assembly having a fluid tip, a body with a central orifice and a set of orifices radially adjacent to the central orifice, an air cap having a set of passages in communication with a set of orifices and a set of conduits contained at least partially within the set of passages, and a plurality of fluid circuits in communication with the nozzle assembly. One of the fluid circuits is adapted to deliver an adhesive, one of the fluid circuits is adapted to deliver an activator, one of the fluid circuits is adapted to deliver atomization air, and one of the fluid circuits is adapted to deliver fan air from the nozzle assembly. The spraying system also includes a controller that can be switched to an active state upon a which the fluid circuit for atomization air and the fluid circuit for fan air are opened essentially simultaneously, the fluid circuit for the activator is opened and then the fluid circuit for the adhesive is opened, and to an inactive state, upon which the fluid circuit for the adhesive and the fluid circuit for the activator are closed essentially simultaneously, and the fluid circuit for atomization air and the fluid circuit for fan air are closed essentially simultaneously. The adhesive is delivered in a generally axial direction through the central orifice in the body, atomization air to atomize the adhesive is delivered in a generally axial direction through the set of orifices in the body, fan air is delivered into the set of passages in the air cap and in a generally radial direction from the set of orifices in the air cap, and the activator is delivered into the set of passages in the air cap from the set of conduits so that the activator is atomized by fan air within the set of passages in the air cap and delivered from the set of orifices of the air cap, so that a fluid mixing area is provided outside the nozzle assembly in a space ahead of the orifices through which the adhesive and atomization air are delivered.

43 Claims, 14 Drawing Sheets

U.S. PATENT DOCUMENTS

| | | | | |
|---|---|---|---|---|
| 2,780,496 | | 2/1957 | Asbeck et al. | 299/140.1 |
| 2,829,006 | | 4/1958 | Johansson | 299/140.1 |
| 2,864,653 | | 12/1958 | Liedberg et al. | 299/140 |
| 2,958,471 | | 11/1960 | Zippel | 239/414 |
| 2,970,773 | | 2/1961 | Keryluk et al. | 239/142 |
| 3,087,682 | | 4/1963 | Peeps | 239/407 |
| 3,229,911 | | 1/1966 | Carlson et al. | 239/142 |
| 3,589,607 | | 6/1971 | Wolf et al. | 239/15 |
| 3,907,202 | | 9/1975 | Binoche | 239/15 |
| 4,187,983 | | 2/1980 | Boyer | 239/9 |
| 4,618,098 | | 10/1986 | Hedger, Jr. et al. | 239/290 |
| 4,760,956 | | 8/1988 | Mansfield | 239/8 |
| 4,817,872 | | 4/1989 | Mattson | 239/300 |
| 4,824,017 | | 4/1989 | Mansfield | 239/9 |
| 4,854,504 | | 8/1989 | Hedger, Jr. et al. | 239/294 |
| 4,891,249 | * | 1/1990 | McIntyre | 239/291 X |
| 4,927,079 | | 5/1990 | Smith | 239/11 |
| 4,967,956 | | 11/1990 | Mansfield | 239/9 |
| 5,080,283 | | 1/1992 | Kukesh et al. | 239/9 |
| 5,170,941 | | 12/1992 | Morita et al. | 239/416.4 |
| 5,209,405 | | 5/1993 | Robinson et al. | 239/296 |
| 5,256,352 | | 10/1993 | Snyder et al. | 261/78.2 |
| 5,303,865 | | 4/1994 | Bert | 239/9 |
| 5,307,992 | | 5/1994 | Hall et al. | 239/135 |
| 5,400,971 | | 3/1995 | Maugans et al. | 239/416.1 |
| 5,419,491 | | 5/1995 | Breitsprecher | 239/9 |
| 5,478,014 | | 12/1995 | Hynds | 239/135 |
| 5,526,981 | | 6/1996 | Sanson | 239/8 |
| 5,558,276 | | 9/1996 | Barrett et al. | 239/135 |
| 5,639,027 | | 6/1997 | Fritz | 239/414 |
| 5,669,557 | | 9/1997 | Barrett et al. | 239/135 |

OTHER PUBLICATIONS

Promotional material for "Variable Spray Autojet© Automatic Air Atomizing Nozzles", by Spraying Systems Co., bearing a designation of "May 13, 1994," 1 sheet.

Promotional material for "Spare Parts List for Spray Gun, Type: HS–25, 2K", by KSG, bearing a designation of "Jun. 18, 1993", 2 sheets.

The Lee Company, "Electro–Fluidic Systems: Component Catalog with Engineering Reference Material", pp. 56, 58, 126, (undated), 5 sheets.

Promotional material for "Airspray Gun—Automatic Model A25 (Without Base) Parts Identification List", by Kremlin, bearing a designation of "17/11/97", 1 sheet.

* cited by examiner

FLUID SPRAYING SYSTEM

FIELD OF THE INVENTION

The present invention generally relates to a fluid spraying system adapted for use within a work environment. In particular, the present invention relates to a fluid spraying system configured to discharge an adhesive on a surface to be coated.

BACKGROUND OF THE INVENTION

It is well known to deliver fluids, such as adhesives, from a spraying system for various purposes. Such known spraying systems are disclosed, for example in U.S. Pat. No. 5,419,491 issued to Breitsprecher on May 30, 1995 titled TWO COMPONENT FLUID SPRAY GUN AND METHOD and in U.S. Pat. No. 5,639,027 issued Jun. 17, 1997 to Fritz titled TWO COMPONENT EXTERNAL MIX SPRAY GUN. Such known spray systems include using air pressure to propel or convey one fluid component and air to propel another fluid component. The two components are mixed and applied to a surface to be coated with the fluids.

One such known spraying system includes a two component external mix spray gun that requires a pneumatically operated valve for delivering a catalyst into pattern shaping air passages in the barrel of the gun. The valve opens in response to pressure created by opening a unitary chamber for a pattern shaping air passage and an atomization air passage. Before opening an adhesive fluid valve for delivering an adhesive of such known gun, a manual trigger operates air valves to provide atomization air and the pattern shaping air. The valve is then opened (prior to the opening of the adhesive fluid valve) in response to an increase in air pressure downstream from the air valves (i.e., in response to the operation of the trigger and the presence of the flow of the pattern shaping air) to inject the catalyst into pattern shaping air passages. Then, external to such known spray gun, the catalyst is brought into contact with the adhesive, which is "atomized" by the atomization air and the pattern shaping air. However, a problem with such known guns is that the manual trigger may not fully open the adhesive fluid valve, which may result in an inconsistent and ineffective ratio of the catalyst to the adhesive and "clogging" of the gun.

Another known spraying system includes an air-operated fluid spray gun for mixing multiple fluids together almost simultaneously to deposit the mixture on a surface. Such mixing and deposition is accomplished by first directing an atomized stream of adhesive fluid axially out of the end of the barrel of the gun and toward the surface to be coated. An atomized stream of activator fluid is then injected generally radially into the adhesive stream so that the activator and adhesive streams mix thoroughly and the mixture is almost simultaneously deposited on the surface. In such known spray guns, the activator fluid is discharged from fluid nozzles. However, a problem with such known spray guns is that the activator is turned on before the adhesive is turned on, which may result in an incorrect ratio of a volume of adhesive to a volume of activator fluid and "clogging" of the gun.

Accordingly, it would be advantageous to provide a fluid spraying system that provides for the independent control of the flow of the various fluids. It would also be advantageous to provide a fluid spraying system that provides for improved atomization of the activator fluid, for example with fan air within the fan air passages of an air cap. It would further be advantageous to provide a fluid spraying system that is intended to be simple to assemble, maintain and service. It would also be advantageous to provide a fluid spraying system that provides a suitable ratio of activator to adhesive. Other advantages of the subject matter recited in the claims will become apparent to those skilled in the art upon review of the specification and the appended claims.

SUMMARY OF THE INVENTION

The present invention relates to a spraying system for delivering a plurality of fluids for applying to a surface. The spraying system includes a nozzle assembly having a fluid tip, a body with a central orifice and a set of orifices radially adjacent to the central orifice, an air cap having a set of passages in communication with a set of orifices and a set of conduits contained at least partially within the set of passages, and a plurality of fluid circuits in communication with the nozzle assembly. One of the fluid circuits is adapted to deliver an adhesive, one of the fluid circuits is adapted to deliver an activator, one of the fluid circuits is adapted to deliver atomization air, and one of the fluid circuits is adapted to deliver fan air from the nozzle assembly. The spraying system also includes a controller that can be switched to an active state upon a which the fluid circuit for atomization air and the fluid circuit for fan air are opened essentially simultaneously, the fluid circuit for the activator is opened and then the fluid circuit for the adhesive is opened, and to an inactive state, upon which the fluid circuit for the adhesive and the fluid circuit for the activator are closed essentially simultaneously, and the fluid circuit for atomization air and the fluid circuit for fan air are closed essentially simultaneously. The adhesive is delivered in a generally axial direction through the central orifice in the body, atomization air to atomize the adhesive is delivered in a generally axial direction through the set of orifices in the body, fan air is delivered into the set of passages in the air cap and in a generally radial direction from the set of orifices in the air cap, and the activator is delivered into the set of passages in the air cap from the set of conduits so that the activator is atomized by fan air within the set of passages in the air cap and delivered from the set of orifices of the air cap, so that a fluid mixing area is provided outside the nozzle assembly in a space ahead of the orifices through which the adhesive and atomization air are delivered.

The present invention also relates to a method to for controlling the fluid circuits in a spraying system for delivering a plurality of fluids for applying to a substrate. The method includes switching a controller to an active state upon a which a fluid circuit for atomization air and a fluid circuit for fan air are opened, opening a fluid circuit for activator and opening a fluid circuit for an adhesive, activating the adhesive with the activator, spraying the activated adhesive on a surface, switching a controller to an inactive state upon which the fluid circuit for the adhesive and the fluid circuit for the activator are closed, purging the system with fan air and atomization air, and closing the fluid circuit for the atomization air and the fluid circuit for the fan air.

DETAILED DESCRIPTION OF THE PREFERRED EMBODIMENTS

Figure 1:
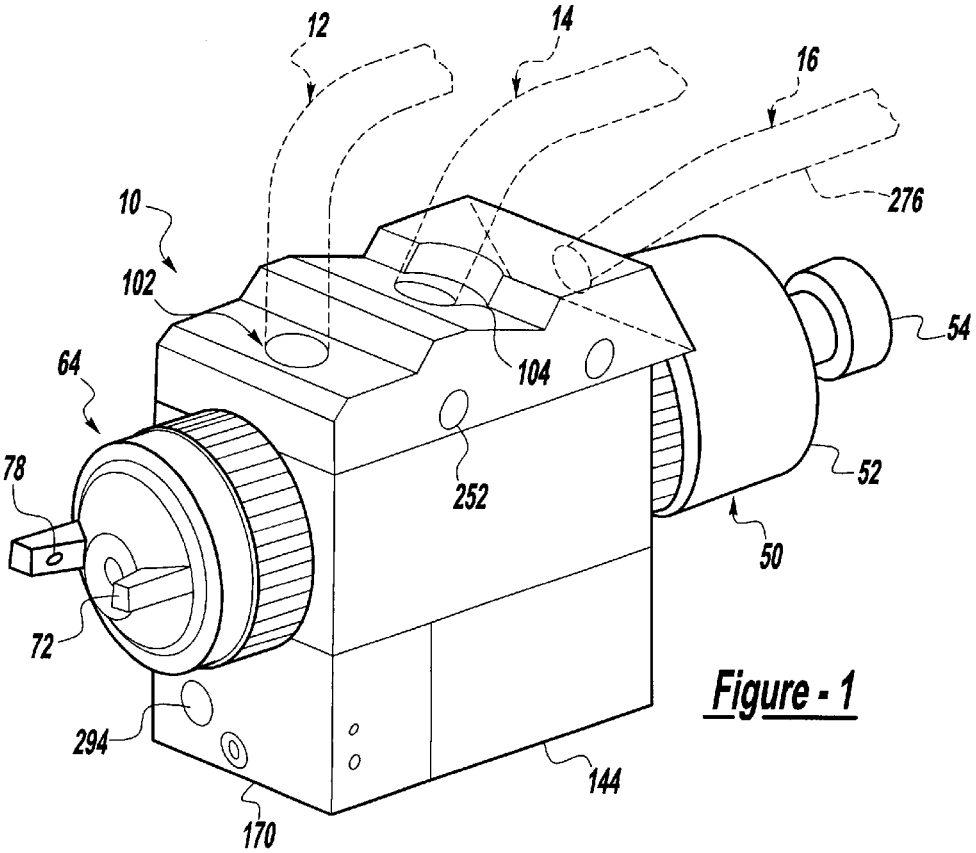
FIG. 1 is a fragmentary perspective view of a fluid spraying system according to an exemplary embodiment of the present invention showing a portion of an adhesive fluid circuit, a fan air fluid circuit and an atomization air fluid circuit.
Figure 2:
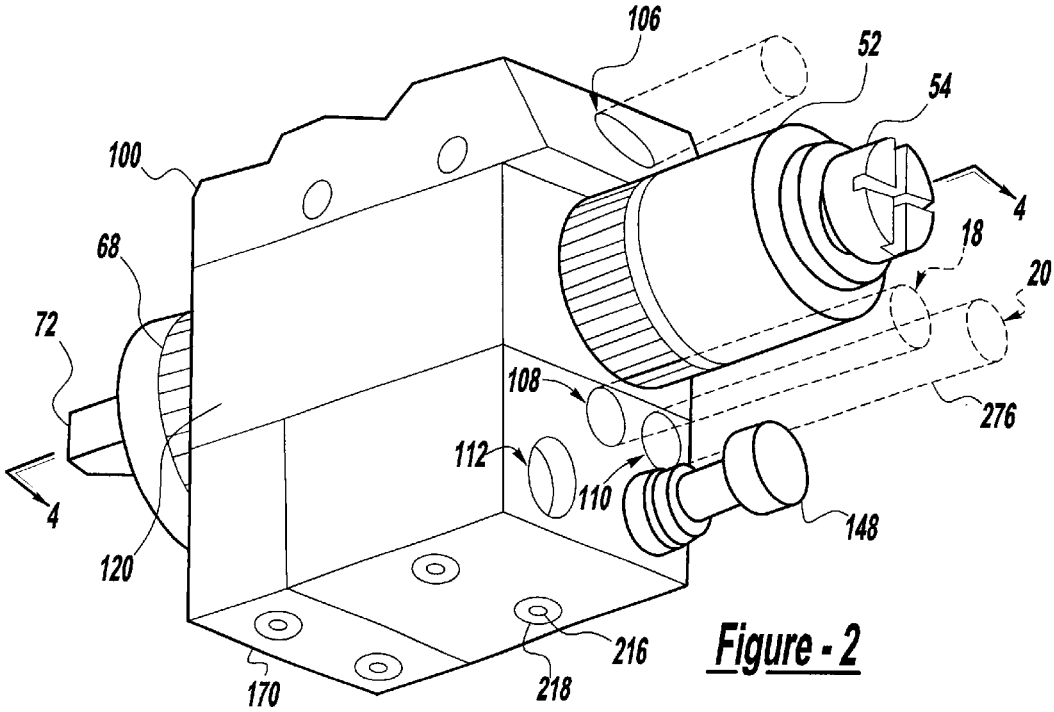
FIG. 2 is a perspective view of the fluid spraying system of FIG. 1 showing a portion of the atomization air fluid circuit, a cylinder air fluid circuit and an activator fluid circuit.

Referring to FIGS. 1 and 2, a fluid spraying system 10 is shown according to an exemplary embodiment of the present invention. According to a preferred embodiment, system 10 is intended to provide for improvement in the function of a spray gun for delivering a two-part water-based adhesive to an external surface (not shown). System 10 delivers four fluids: a primary fluid such as an adhesive, a secondary fluid such as an activator, a discharge fluid such as atomization air, and a discharge fluid such as fan air. Also provided is a pneumatic fluid such as cylinder air. System 10 includes four fluid circuits: an adhesive fluid circuit 12, a fan air fluid circuit 14, an atomization air fluid circuit 16, and an activator fluid circuit 20. Also provided is a cylinder air fluid circuit 18(see FIG. 2). Each fluid circuit flows through a body or block (shown as a housing 120) providing an air cap assembly 64 and a nozzle assembly 86.

The term "circuit" refers to any system of one or more passages, conduits, chambers, channels, or the like allowing or providing for the flow of one or more fluids. The term "flow" refers to the routing, direction, channeling, moving, circulation, etc. of a volume or quantity of a fluid a certain rate or pressure. The term "fluid" refers to any material that is capable of flowing, such as a liquid or a gas or combinations thereof.

The adhesive flows through an outlet 76 of air cap assembly 64 in a generally axial direction through a central cavity 140 of housing 120. A piston assembly 22 and a needle assembly 40, which are controlled by the cylinder air, turn on or off the discharge of the adhesive through outlet 76. The atomization air, which "atomizes" (i.e., the breaking of a fluid (e.g., adhesive, activator, water, etc.) into small droplets or bubbles that are equally distributed in a fluid stream), flows in a generally axial direction to outlet 76 through an outlet 74 that circumscribes outlet 76. Fan air flows in a generally axial direction through a vertical fan air conduit 136 leading to a set of radial ports 94 in a nozzle 88 positioned at a radial distance from radial ports 92. The adhesive and the atomization air flow to air cap assembly 64 through radial ports 92. The activator flows to air cap assembly 64 through a set of separate threaded needle tubes 192 within a fan air chamber 82 of air cap assembly 64. (The activator is "atomized" by the fan air within a fan air passage 62 of an air cap 70; each of separate needle tubes 192 for the activator terminates within air cap 70 so that the atoniization occurs throughout the length of fan air passage 62 and not only as the activator is ejected from air cap 70.) An atomized adhesive fluid stream 200 and an atomized activator fluid stream 206 are mixed at an impinging area 208 external to air cap 70 (see FIG. 11).

System 10 includes a number of removable parts and assemblies intended for simple construction, maintenance and servicing. A ring 58 of an end cap assembly 50 is threadedly connected to a protrusion 114 of housing 120. Piston assembly 22 is configured for radial movement within end cap assembly 50. A fluid connector block or manifold 100 (with associated plenium) is mounted to housing 120 by fasteners (shown as a threaded screw 298) fit through an aperture 296. Plenum 100 is intended to provide a coupling point for an adhesive source 36, a fan air source 38 and an atomization air source 44. An activator block 170 and a secondary block 144 are mounted to housing 120 by fasteners (shown as threaded screws 294) fit through apertures 292. Secondary block 144 is intended to provide a coupling point for a cylinder air source 56 and an activator source 46, as well as a vertical mounting hole 112 for attaching housing 120 to a handle and/or trigger assembly (not shown). A retaining ring 68 of air cap assembly 64 is threadedly connected to a protruding ring 186 of housing 120. Nozzle assembly 86 is disposed within air cap assembly 64 and is intended to provide a distribution point for distributing the adhesive, atomization air and fan air.

Figure 11:
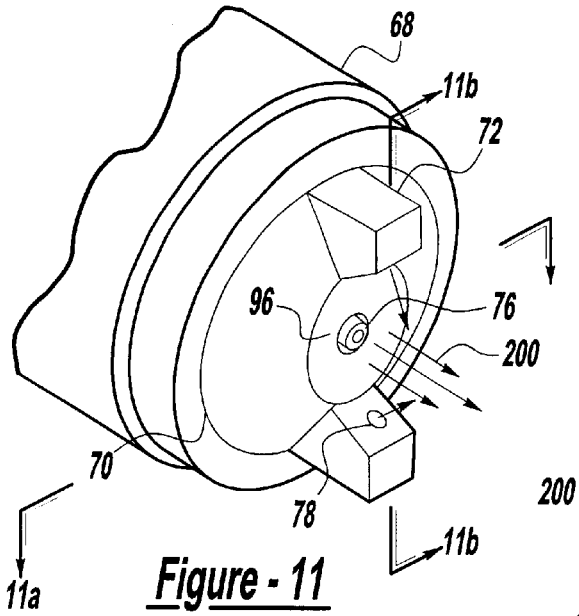
FIG. 11 is a fragmentary perspective view of the air cap assembly.
Figure 11A:
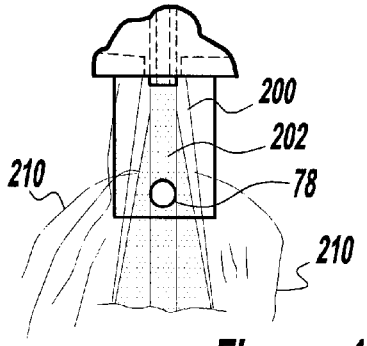
FIG. 11A is a fragmentary cross-sectional view of the air cap assembly taken along line 11*a*—11*a* of FIG. 11.
Figure 11B:
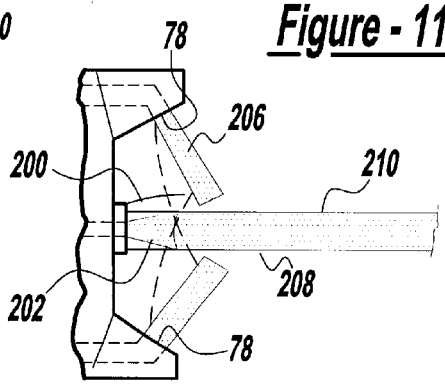
FIG. 11B is a fragmentary cross-sectional view of the air cap assembly taken along line 11*b*—11*b* of FIG. 11.

The clogging of fluid spraying system 10 (e.g., blockage of the fluid circuits, inlets, intakes, outlets, discharges, ports, etc. that may result in the fluid spraying system from operating efficiently) is intended to be reduced by the activator being turned on and off timed with the adhesive being turned on and off to correctly break any water from the adhesive and to provide the proper ratio of activator to adhesive. The activator is "atomized" by fan air within fan air passage 62 of an air horn (shown as a wing 72) of air cap 70 and the adhesive is "atomized" by the atomization air as it is discharged from air cap 70 through outlet 76 and outlet 74. The fan air may also assist in breaking any water from the adhesive. Referring to FIG. 11, adhesive is atomized by the atomization air and the fan air (having activator fluid) such that a substantial portion of any water in the adhesive is driven off. The adhesive and the atomization air are discharged from air cap 70 through outlet 76 and outlet 74 to form resulting atomized adhesive fluid stream 200, which is generally cone-shaped (see FIGS. 11A–11B). The activator is "atomized" by the fan air in fan air passage 62 of wing 72 to form a resulting atomized activator fluid stream 206 (see FIG. 11B). Atomized actuator fluid stream 206 is discharged from an output 78 at about a 60-degree angle relative to atomized adhesive fluid stream 200. Atomized activator fluid stream 206 comes in contact with atomized adhesive fluid stream 200 at impinging area 208 external to air cap 70, which may result in further atomization of the adhesive, to form a resulting activated adhesive fluid stream 210. Atomized activator fluid stream 206 tends to narrow or flatten the cone shape of atomized adhesive fluid stream 200. Activated adhesive fluid stream 210 consists of generally equally distributed activated adhesive droplets that form from the separation of the adhesive (which may be an adhesive and water emulsion) and water (which may be held together by a surfactant). Activated adhesive fluid stream 210 may subsequently be discharged on a substrate or surface to be covered (not shown) such as a mylar film, a paper, a work surface, an article of furniture, an architectural wall, a work environment accessory, etc. According to alternative embodiments, the atomized activator fluid stream may impinge upon the atomized fluid stream at any oblique angle relative to the needle. It is intended that fan air discharged from the air cap at a high pressure will tend to widen the "fan" shape of the atomized adhesive fluid stream.

It is intended that the clogging of fluid spraying system 10 (e.g., blockage of the fluid circuits, inlets, intakes, outlets, discharges, ports, etc.) and inconsistent ratios of adhesive to activator may be further inhibited by using a pressure adjustment mechanisms (shown as an activator flow control assembly 146 for the activator fluid circuit) to regulate or control the flow (i.e., volume and rate of the fluids through the respective fluid circuits) of each fluid circuit. According to a particularly preferred embodiment, each of the fluid circuits may be electronically controlled (i.e., turned on or off) for certain periods (e.g., the time the activator fluid stream meets the adhesive fluid stream at the impinging area) to provide for the desired rate, volume, pressure, quantity, etc. of fluid (e.g., the flow of the activator may be precisely metered to the corresponding flow of the adhesive). Such independent control by the pressure adjustment mechanisms is intended to provide for uniformity and consistency of the application of, for example, a two-part water-based adhesive. In particular, an activator delivery metering system (not shown) controlled at least in part by activator flow control assembly 146 may be configured to provide for "linearity" as adjustments are made over the range of adjustment of the flow of the activator fluid. "Linearity" is the even, controlled, uniform, etc. flow of a fluid through a fluid circuit. According to a particularly preferred embodiment, the activator flow control screw delivers a volume of activator fluid in linear increments of rotation of the flow control screw. According to alternative embodiments, the pressures of each fluid circuit may be regulated in relation to the other circuits (e.g., the flow pressure of the adhesive to the flow pressure of the activator may be set at a ratio of about 8:1 or 22:1). According to a particularly preferred embodiment, the ratio of the adhesive to the activator is determined by the molecular makeup of the adhesive.

Figure 21:
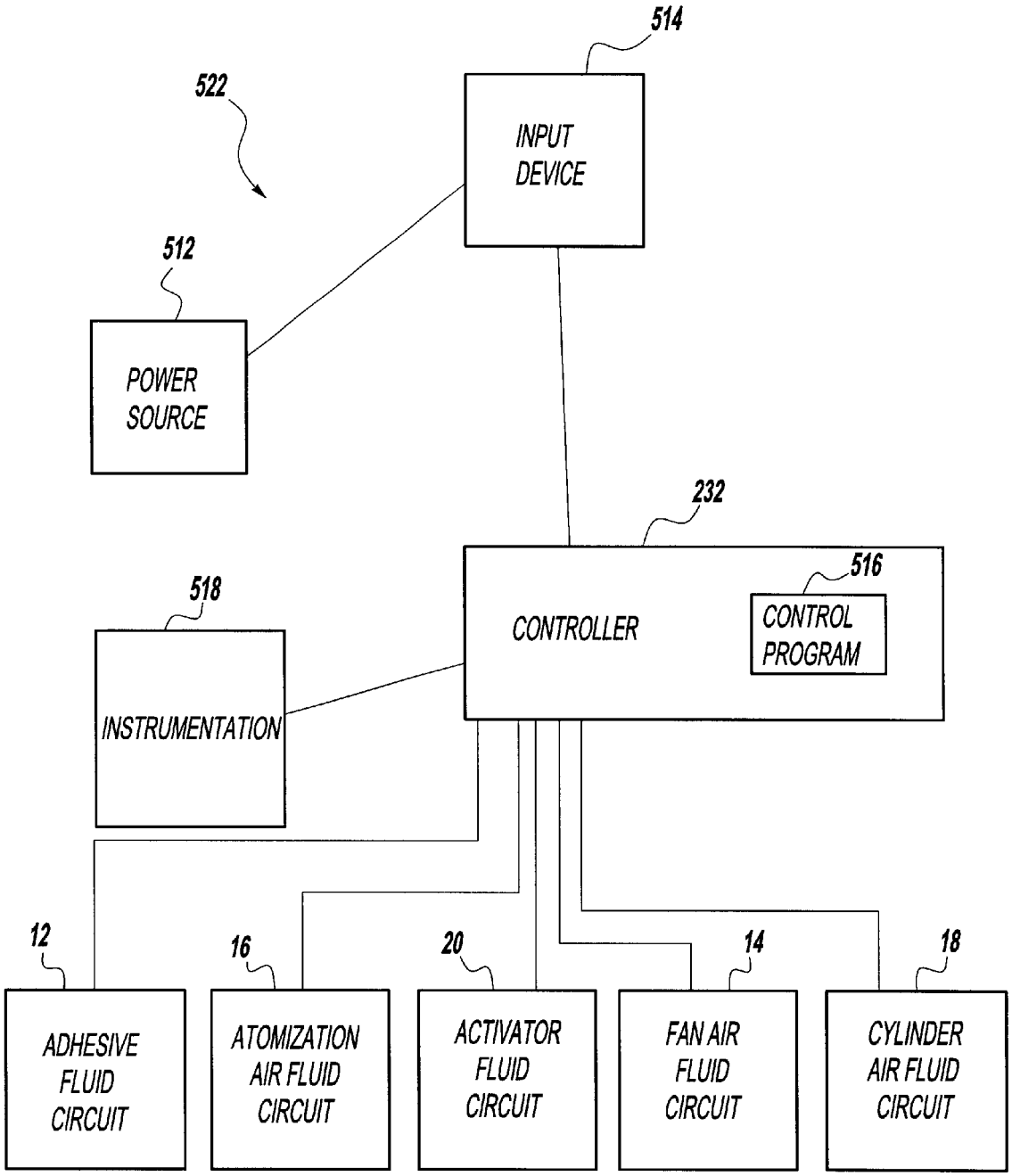
FIG. 21 is a schematic representation of a control system.

Referring to FIG. 21, a schematic representation of a control system 522 for fluid spraying system 10 is shown according to a preferred embodiment. Control system 522 is intended to provide for the independent regulation of fluids through the fluid circuits. Control system 522 may include a controller 232 such as a programmable logic controller under the operation of a control program 516 (e.g., implemented in software). An input device 514 (e.g. a trigger, touch-pad, keyboard, keypad, sensors, etc.) for actuation of fluid spraying system 10 is coupled to controller 232. Other instrumentation 518 (such as a display screen, gauges, monitors, touch-pad, user interface or other indicators of any type) as well as other input devices (not shown) may also be coupled to controller 232. Control system 522 (and other elements of fluid spraying system 10) may be powered by a power source 512. According to a particularly preferred embodiment, the power source is a 24 volt DC power supply. According to alternative embodiments, multiple power sources may be coupled to the controller (e.g., a separate power source for each fluid circuit).

As will be apparent to those of ordinary skill who review this disclosure, the control system and its controller may also have associated with it timing and/or control circuits activated by input devices, power sources, memory storage modules, display systems and/or instrumentation (e.g., regulators, sensors for monitoring temperature, volume, pressure or other variables, heating and/or cooling systems, etc.) and the like. According to a preferred embodiment, the control system implements the control program in a series of steps (which may according to alternative embodiments be implemented in a variety of other sequences and/or with a variety of other inputs, outputs, steps or instructions). According to alternative embodiments, the control system may be implemented in a stand-alone digital processor, or integrated with a microprocessor of the like used to monitor and/or control other fluid spraying systems and functions. The control system is not intended to be limited to any particular type of controller capable of implementing the intended functionality (i.e., regulating the flow of the fluids through the fluid circuits).

The control system, according to a preferred embodiment, may include a programmable logic controller (such as a PLC that performs "ladder logic" operations for implementing a control program and which provides output signals based on input signals provided by an operator or otherwise acquired). According to a particularly preferred embodiment, the controller is a Micrologic 1000 PLC Model #1761-L32 BWA commercially available from Rockwell Automation Allen-Bradley Corporation of Milwaukee, Wis. According to alternative embodiments, other suitable controllers of any type may be included in the control system. For example, controllers of a type that may include a microprocessor, microcomputer or programmable digital processor, with associated software, operating systems and/or any other associated programs to collectively implement the control program may be employed. According to alternative embodiments, the controller and its associated control program may be implemented in hardware, software or a combination thereof, or in a central program implemented in any of a variety of forms. According to a particularly preferred embodiment, input to the control program is provided by turning a trigger "on" and the control program performs operations (i.e., turning valves "on" and "off" in certain sequences or for certain periods) while the trigger is "on" and for a period after the trigger is turned "off".

Figure 10:
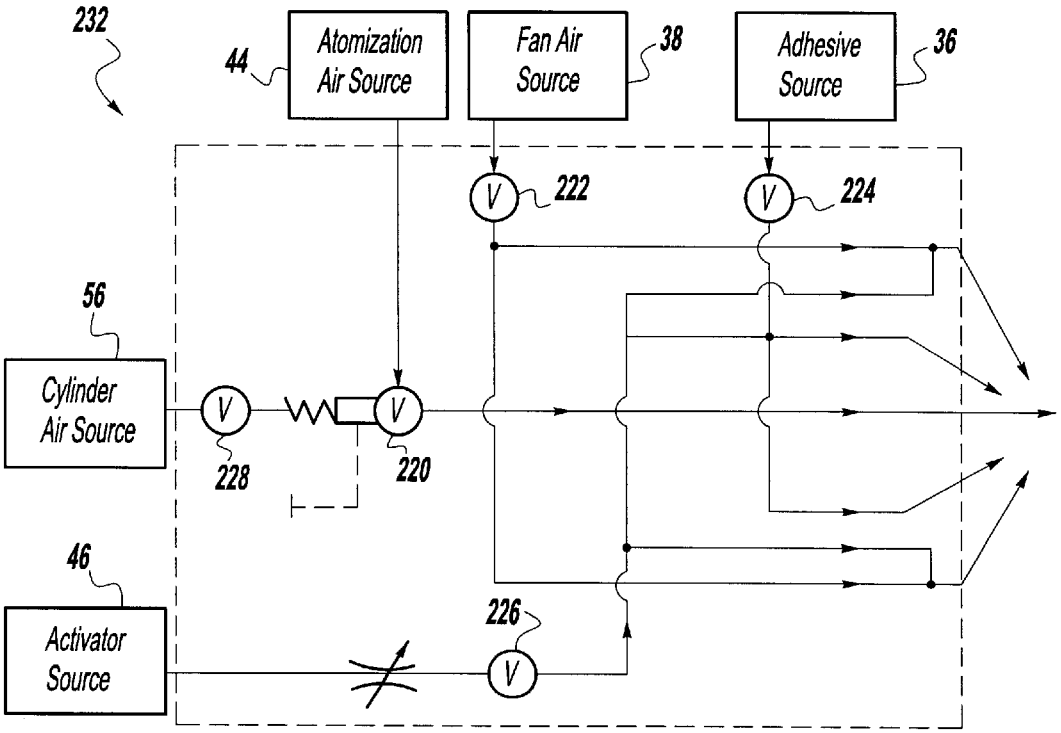
FIG. 10 is a schematic diagram of the electronic circuitry of the fluid spraying system.

Referring to FIG. 10, a schematic diagram of the electronic circuitry regulated by control system 522 is shown according to a preferred embodiment. The turning on and off of each fluid through each fluid circuit is individually regulated by control system 522. Control system 522 turns valve 226 "on" and "off" in response to input or output from controller 232. When valve 226 is turned "on", compressed air exerts a pressure on the activator fluid in activator source 46 (e.g., acting as a "pressure pot") to cause the activator fluid to flow through activator fluid circuit 20 under pressure. (The volume and rate of the activator in the fluid spraying system is further regulated by activator flow control assembly 146.) In a similar manner, compressed air in fluid communication with adhesive source 36 forces the adhesive fluid through adhesive fluid circuit 12 (e.g., acting as a "pressure pot"). A control element (shown as a solenoid valve 224) turned "on" and "off" by controller 232 regulates the flow of the adhesive through adhesive fluid circuit 12. A control element shown as a solenoid valve 220 is turned "on" and "off" by controller 232 to turn on and off the atomization air through atomization air fluid circuit 16; a control element shown as a solenoid valve 222 is turned "on" and "off" by controller 232 to turn on and off the fan air through fan air fluid circuit 14; and a control element shown as a solenoid valve 228 turned "on" and "off" by controller 232 to turn on and off the cylinder air through cylinder air fluid circuit 18. According to a preferred embodiment, individual check valves, which may have display gauges, monitors, user interfaces, etc., may be manipulated to regulate the pressure of the compressed air in the adhesive fluid circuit, the atomization air fluid circuit, the activator fluid circuit, the fan air fluid circuit and the cylinder air fluid circuit. According to an alternative embodiment as shown in FIG. 10, a control element shown as a solenoid valve 226 may regulate the flow of the activator through activator fluid circuit 20.

Figure 22:
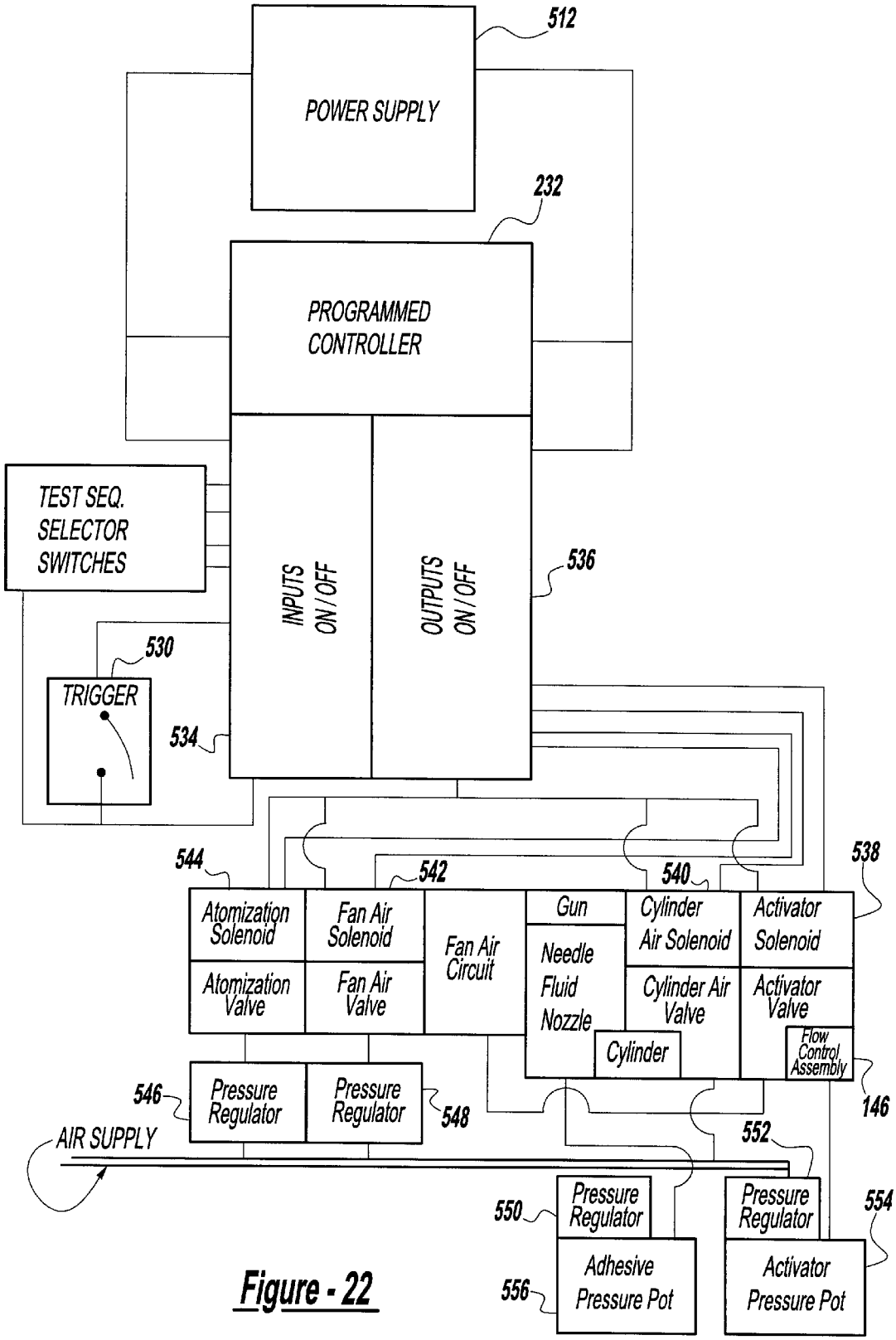
FIG. 22 is a schematic representation of a control system according to a particularly preferred embodiment.

Referring to FIG. 22, a schematic representation of control system 522 for fluid spraying system 10 is shown according to a particularly preferred embodiment. Control system 522 includes controller 232 powered by power supply 512. A switch control 532 selects certain modules or test programs (e.g., purge test, viscosity test, system off, etc.) to be run when a trigger 530 is turned on. Inputs 534 are processed by a control program of controller 232, which provides outputs 536. Outputs 536 turn an activator solenoid 538 on or off. Likewise, outputs 536 turn a cylinder air solenoid 540, a fan air solenoid 542, and an atomization air solenoid 544 on or off. When a solenoid is turned on, fluid may flow through a fluid circuit, and when a solenoid is turned off, fluid is inhibited from flowing through a fluid circuit. For example, when cylinder air solenoid 540 is turned on, piston 34 and needle 42 are retracted so that adhesive may flow through adhesive fluid circuit 12 and be discharged through outlet 76.

Referring further to FIG. 22, pressure control mechanisms (shown as pressure regulators 546, 548, 550 and 552) regulate the air pressure through each fluid circuit. For example, pressurized air from an air supply is controlled by regulator 552 so that air pressure is applied on activator fluid in an activator fluid source (shown as a pressure pot 554). Activator flows from pressure pot 554 to activator flow control assembly 146, which linear selected volumes of activator fluid in activator fluid circuit 20. Likewise, pressurized air from an air supply is regulated by pressure regulator 550 so that a pressure is applied to adhesive fluid in an adhesive fluid source (shown as a pressure pot 556). Adhesive flows from pressure pot 556 to nozzle assembly 86 and is discharged through outlet 76.

Figure 14:
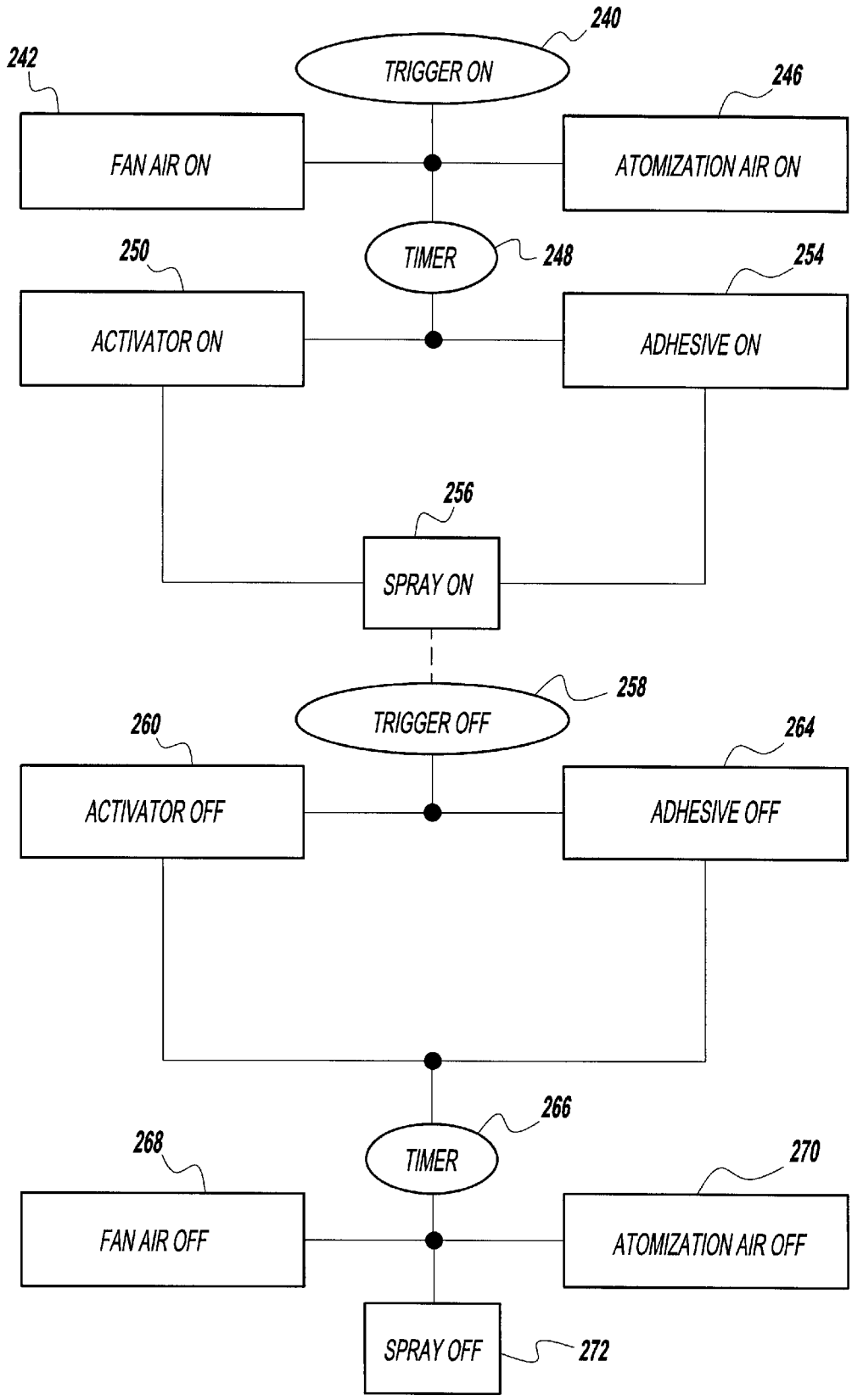
FIG. 14 team is a flow chart of the sequence in which the fluid circuits of the fluid spraying system are turned on and off.

The clogging of fluid spraying system 10 (e.g., blockage of the fluid circuits, inlets, intakes, outlets, discharges, ports, etc.) is intended to be reduced by turning the fluid circuits "on" and "off" in a particular sequence, order, cycle, etc. Referring to FIG. 14, a flow chart detailing the sequence in which the fluid circuits are turned "on" and "off" is shown according to a preferred embodiment of the present invention. The turning "on" of an input device or trigger (step 240) turns on operation of control system 522. Upon turning "on" the trigger, valve 222 and valve 220 are opened so that fan air and atomization air flow through the respective fluid circuits (step 242 and step 246). Turning the fan air "on" (step 242) and turning the atomization air "on" (step 246) purges any debris or excess fluids from fan air fluid circuit 14, atomization air fluid circuit 16 and discharge 96 for a pre-selected period selectable by a timer 248. Turning the fan air "on" and turning the atomization air "on" before turning the adhesive "on" and the activator "on" is intended to provide for a balanced, linear air flow through the respective fluid circuits. Also, turning the fan air "on" and turning the atomization air "on" before turning the adhesive "on" and the activator "on" is intended to provide a path for the atomization air and the fan air toward the substrate or surface. Such path is intended to provide a direct route for the activated adhesive fluid stream from the nozzle to the substrate, such that any water in the adhesive may be deflected towards the periphery of the path, which according to an alternative embodiment, may be collected in a filter mechanism (not shown) such as a vacuum.

Upon completion of the purge, as measured by a timer (step 248), valve 226 is opened so that the activator fluid flows through activator fluid circuit 20 (step 250) and valve 228 is opened so that the cylinder air flows through cylinder air fluid circuit 18 to turn on the flow of the adhesive through adhesive fluid circuit 12 (step 254). Turning the activator fluid "on" (step 250) and turning the adhesive "on" (step 254) occurs generally simultaneously such that the adhesive and the activator both reach impinging area 208 at about the same time (step 256) such that a fluid stream is discharged external to air cap 70 (i.e., system 10 discharges an atomized "spray" which is a combination of adhesive, atomization air, activator, fan air and atomized combinations thereof).

Activated adhesive fluid stream 210 is discharged on the substrate until the trigger is turned "off" (step 258). Turning the trigger "off" (step 258) causes the flow of the activator to subsist (step 260) and the cylinder air to subsist, which in turn turns "off" the flow of the adhesive (step 264). Turning the activator fluid "off" (step 260) and turning the adhesive "off" (step 264) occur generally simultaneously. Subsequently, fan air and atomization air continue to purge fan air fluid circuit 14, atomization air fluid circuit 16 and discharge 96 for a period controlled by a timer 266. The fan air is then turned "off" (step 268) and the atomization air is then turned "off" (step 270) so that no fluid is discharged or sprayed from air cap 70 (step 272).

Figure 4:
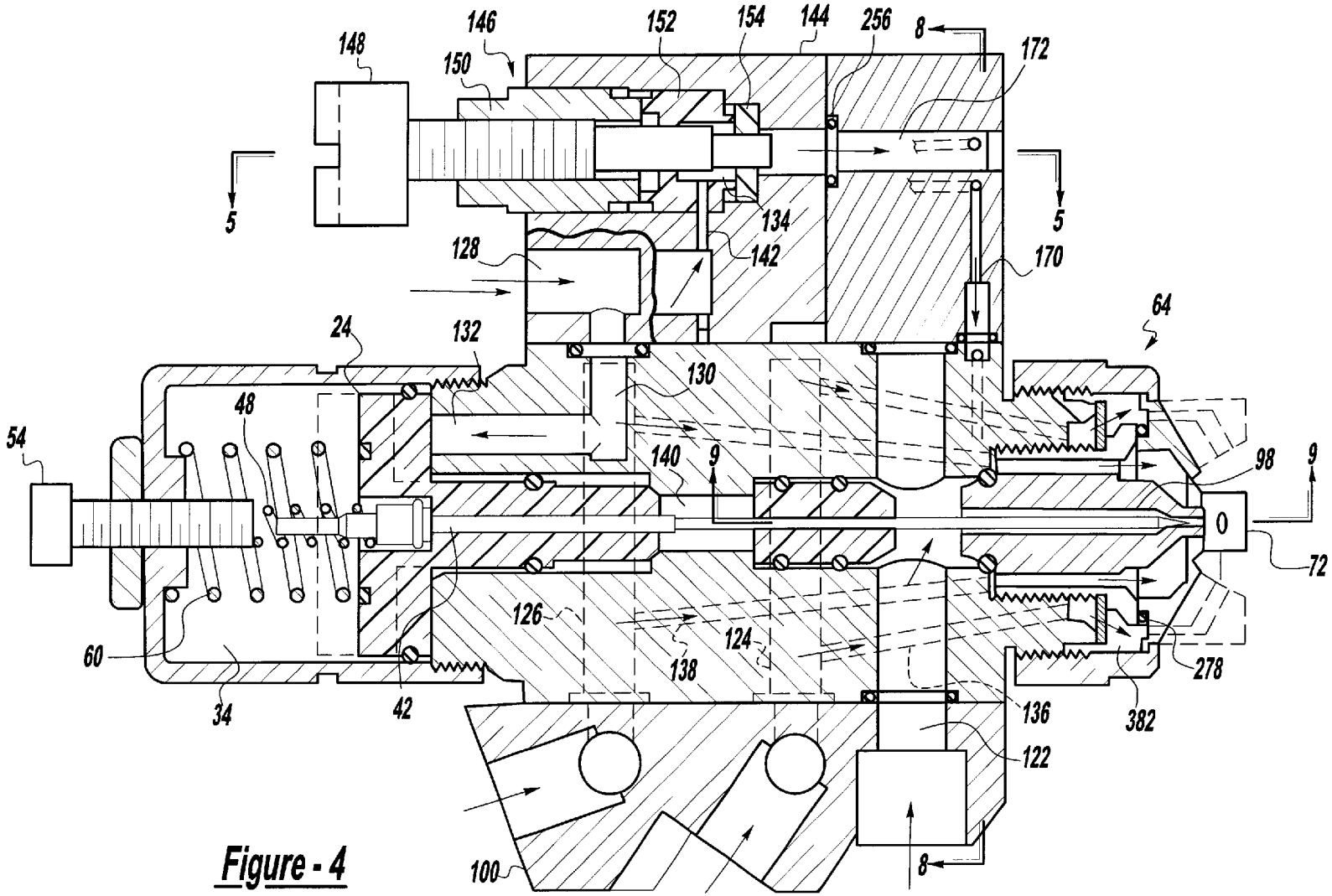
FIG. 4 is a cross-sectional view of the fluid spraying system of FIG. 1 taken along line 4—4 of FIG. 2.

Referring to FIG. 4, piston assembly 22 is shown disposed within a chamber 32 of end cap assembly 50. Piston assembly 22 includes a generally circular-shaped piston 24 having a top surface 26 and a bottom surface 28. A generally cylindrical protrusion 30 for guiding a needle 42 of needle assembly 40 extends from top surface 26 of piston 24. Piston assembly 22 also includes a piston spring 60 disposed between an end cap 52 of end cap assembly 50 and bottom surface 28 of piston 24.

In operation of piston assembly 22, a full supply line pressure of cylinder air is forced against top surface 26 of piston 24 causing the compression of piston spring 60 and the retraction of needle 42 toward an adjustment screw 54 (see FIG. 4). When the pressure of the cylinder air subsides, piston spring 60 decompresses to return piston 24 toward air cap 70. When piston 24 is retracted toward adjustment screw 54, needle 42 is likewise retracted toward adjustment screw 54 and a needle spring 48 is compressed. When needle spring 48 is decompressed, needle 42 is returned toward air cap 70. According to a particularly preferred embodiment, the end cap assembly includes a three way valve to discharge air from the end cap assembly to the atmosphere so that the piston may retract when the cylinder air is turned off.

It is intended that the clogging of fluid spraying system 10 (e.g., blockage of the fluid circuits, inlets, intakes, outlets, discharges, ports, etc.) be further reduced by a fast-acting needle valve. According to a particularly preferred embodiment, the flow of the adhesive through outlet 76 is turned on and off by needle 42, which coacts with outlet 76 to operate as a fast-acting valve, and is intended to provide a rapid transition (i.e., using an electronic control) from an opened position to a closed position (see FIG. 3). When the cylinder air is turned on, needle 42 retracts towards adjustment screw 54 and the adhesive is discharged through outlet 76 of air cap 70; when the cylinder air is turned off, needle 42 is returned toward air cap 70 such that the flow of the adhesive is inhibited from being discharged from outlet 76. According to an alternative embodiment as shown in FIG. 4, the distance that adjustment screw 54 is extended or retracted within end cap 52 may be varied to compress or decompress needle spring 48 and adjust the rate needle 42 extends and retracts relative to end cap 52. As a result, the rate at which needle 42 is axially extended and retracted (i.e., moved from the opened position to the closed position) within outlet 76 may be varied. According to a particularly preferred embodiment, the needle is either fully retracted or fully extended, which is intended to provide effective metering of the amount of adhesive that is discharged from the fluid spraying system. Piston assembly 22 and needle assembly 40 include seals to inhibit air and adhesive from leaking into chamber 32. An annular seal (shown as an O-ring 288) is disposed around piston 24 to inhibit the cylinder air from entering a spring chamber 34 and an O-ring 290) is disposed around protrusion 30 of piston 24 to inhibit the adhesive in central cavity 140 from entering chamber 32.

Referring to FIG. 4, the flow of each fluid circuit for each fluid (i.e., adhesive, atomization air, activator, fan air and cylinder air) is shown. The adhesive from the adhesive source flows through a tube 276 to an adhesive intake 102 of plenum 100. The adhesive then flows into a transverse adhesive conduit 122, which is in fluid flow communication with central cavity 140. As needle 42 is retracted toward adjustment screw 54, the adhesive is permitted to be discharged from air cap assembly 64 through outlet 76.

Atomization air from the atomization air source flows through tube 276 to an atomization air intake 106 of plenum 100. The atomization air then flows into a transverse atomization air conduit 126, which is in fluid flow communication with a vertical atomization air conduit 138 generally co-axial with needle 42. The atomization air then flows through a central orifice 116 of nozzle 88 to an atomization air chamber 84 of air cap 70. The atomization air is then discharged from air cap 70 through outlet 74.

Referring further to FIG. 4, fan air from the fan air source flows through tube 276 to fan air intake 104 of plenum 100. The fan air then flows into a transverse fan air conduit 124, which is in fluid flow communication with vertical fan air conduit 136 generally co-axial with needle 42. The fan air then flows through radial ports 94 of a distribution ring 90 of nozzle 88 to fan air chamber 82 of air cap 70. The fan air then flows through fan air passage 62 of air cap 70 and discharged from wing 72 through an outlet 78.

The activator from the activator source flows through tube 276 to activator intake 110 of secondary block 144. The activator then flows into a transverse activator channel 142 to an activator cavity 134. As a screw 148 is retracted from secondary block 144, the activator flows from activator cavity 134 to an activator channel 172. The activator then flows through an inlet 178 of a solenoid 176. A gate 180 regulates the passage of the activator from inlet 178 to an outlet 182 of solenoid 176. From outlet 182, the activator then flows to a Y-shaped diverter 188, and then to an activator tube 190 and through needle tubes 192. The fan air within fan air passage 62 atomizes the activator and the resulting atomized activator fluid stream 206 is discharged from air cap 70 through outlet 78.

Cylinder air from the cylinder air source flows through tube 276 to cylinder air intake 108 of secondary block 144. The cylinder air then flows into a transverse cylinder air conduit 130, which is in fluid flow communication with a vertical cylinder air conduit 132 generally co-axial with needle 42. When the cylinder air is turned on, a blast of cylinder air is forced against top surface 26 of piston 24 to cause needle assembly 40 to extend and retract relative to adjustment screw 54; when the cylinder air is turned off, needle assembly 40 returns or extends relative to adjustment screw 54. The turning on and off of the cylinder air occurs at a rapid rate of speed, causing needle assembly 40 to extend and retract at a rapid rate of speed. Such rapid extension and retraction of needle assembly 40 is intended to assist in reducing the discharge of adhesive from outlet 76.

Figure 12:
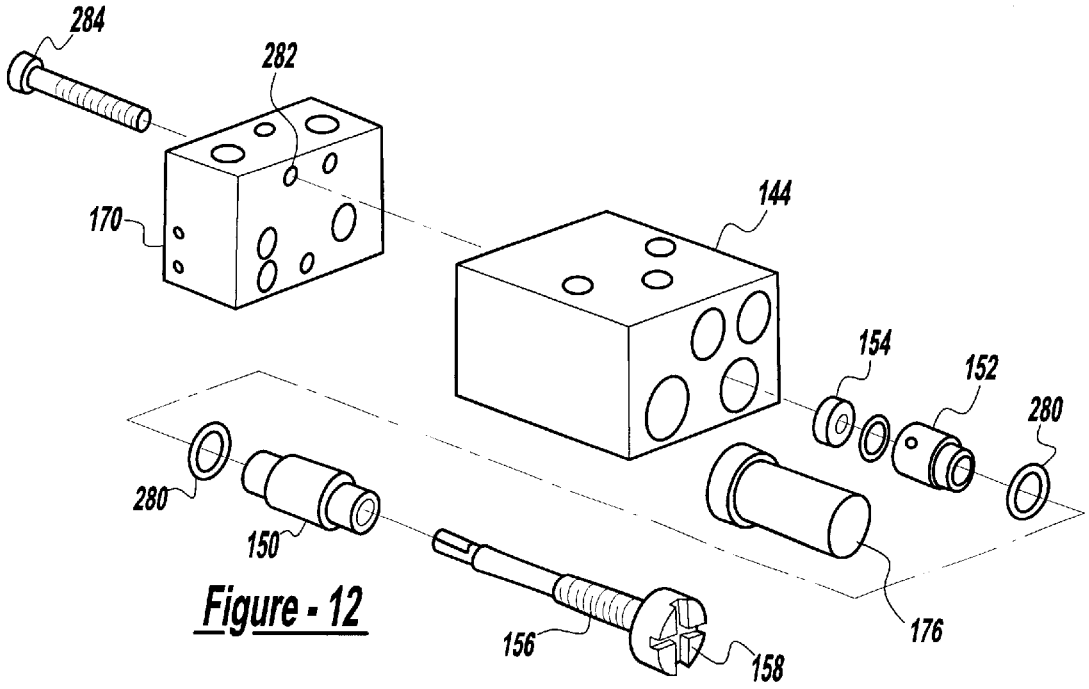
FIG. 12 is an exploded perspective view of the activator block and the secondary block.

Housing 120 is intended to provide a mounting point for attaching components of system 10 such as plenum 100, activator block 170 and secondary block 144 (see FIG. 12). Central cavity 140 of housing 120 includes a storage area for the adhesive. A generally frusto-conical shaped cartridge 98 is disposed within central cavity 140. Threaded screws 298 are fit through apertures 296 and spacers 286 (e.g., washers, seals, O-rings, etc.) to mount activator block 170, secondary block 144 and plenum 100 to housing 120. Protruding ring 186 of housing 120 is threadedly connected to retaining ring 68. Protruding ring 186 includes radial ports 214 for the flow of fan air through fan air fluid circuit 14, and radial ports 212 for the flow of the atomization air through atomization air fluid circuit 16. Ports 212 and 214 are generally evenly spaced from each other and about the internal periphery of protruding ring 186. (Ports 214 are spaced a greater distance from the center of protruding ring 186 than are ports 212.) A lower portion of nozzle assembly 86 fits within protruding ring 186, and distribution ring 90 abuts against protruding ring 186. Distribution ring 90 includes radial ports 92 for the flow of the atomization air through atomization air fluid circuit 16, and radial ports 94 for the flow of the fan air through the fan air fluid circuit 14. Radial ports 92 and 94 are generally evenly spaced from each other. Housing 120 also includes passages for the flow of the fluids through the fluid circuits of fluid spraying system 10.

Plenum 100 includes intakes for receiving fluids (e.g., adhesive, atomization air, activator, fan air, cylinder air, etc.) from the sources external to housing 120. Adhesive intake 102, fan air intake 104 and atomization air intake 106 of plenum 100 are connected to each respective source by a hollow elongate flexible member (shown as tubes 276). Intakes 102, 104 and 106 are in fluid flow communication with fluid circuits 12, 14 and 16, respectively. Intakes 102 and 104 are generally perpendicular to needle 42, transverse adhesive conduit 122, transverse fan air conduit 124 and transverse atomization air conduit 126. Intake 106 is generally coaxial with needle 42. Plenum 100 may also include apertures 252, which may be threaded, for fasteners or set screws (not shown) for mounting plenum 100 to the handle and/or trigger assembly.

Secondary block 144 is mounted to housing 120 and to activator block 170 by fasteners (shown as threaded screws 284) fit trough apertures 282. Secondary block 144 includes intakes for receiving the fluids from the sources external to housing 120. A hollow elongate flexible member (shown as tubes 276) connects activator intake 110 and cylinder air intake 108 of secondary block 144 to each respective source. Intakes 108 and 110 are in fluid flow communication with fluid circuits 18 and 20, respectively. Intakes 108 and 110 are generally coaxial with needle 42. Guide holes 218, which may assist in manufacturing for drilling, boring, or molding conduits, channels or passage, may be included in activator block 170 and secondary block 144 and filled with spacers or plugs 216. According to any alternative or preferred embodiment, any fastener may connect the hollow elongate flexible members to the secondary block and/or the plenum (e.g., capture clamp, bayonet twistlock fastener, spring clips, etc.).

Figure 6:
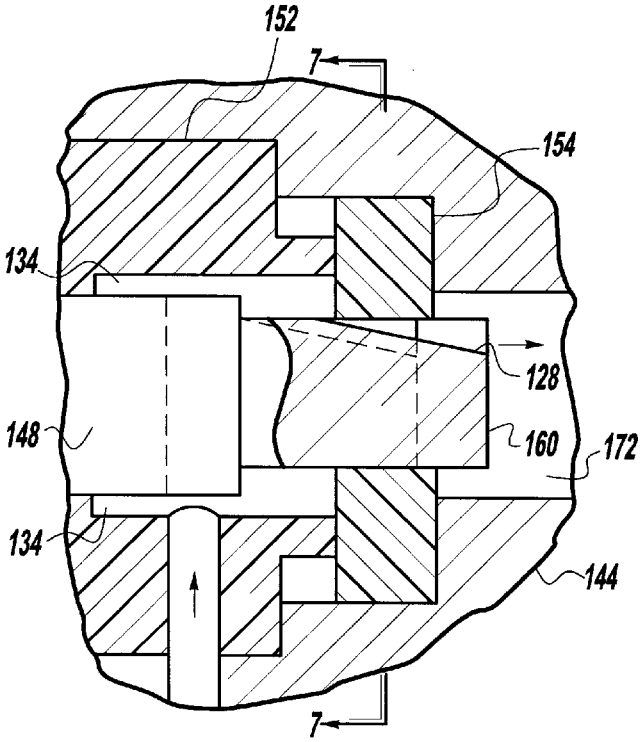
FIG. 6 a fragmentary cross-sectional view of the flow control assembly.
Figure 7:
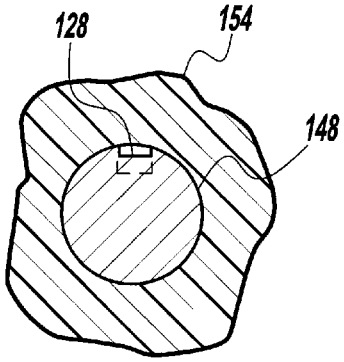
FIG. 7 is fragmentary a cross-sectional view the flow control assembly taken along line 7—7 of FIG. 6.

Activator flow control assembly 146 is mounted to secondary block 144 (see FIGS. 6–7 and 12). Activator flow control assembly 146 variably adjusts the amount of activator that is mixed with the fan air in fan air passage 62. Activator flow control assembly 146 includes screw 148 having a threaded end 156 disposed within and surrounded by a jamb nut 150, a medial portion 158 disposed within a spacer 152 and a terminal end 160 surrounded by a flexible, a radial seal 154. Terminal end 160 of screw 148 includes a groove having a leading edge 128. In operation of activator flow control assembly 146, screw 148 is retracted from secondary block 144 to expose a greater portion of leading edge 128 to seal 154 such that a volume of the activator may flow from activator cavity 134 to activator channel 172. As screw 148 is extended into secondary block 144, a lesser portion of leading edge 128 is exposed to seal 154 such that leading edge 128 abuts against seal 154 to inhibit the flow of the activator from activator cavity 134 to activator channel 172. According to any alternative or preferred embodiment as shown in the FIGURES, seals (shown as O-rings 234) may be disposed between secondary block 144 and activator block 170 to inhibit the activator from leaking from activator channel 172, and may be disposed between screw 148 and seal 154.

Figure 5:
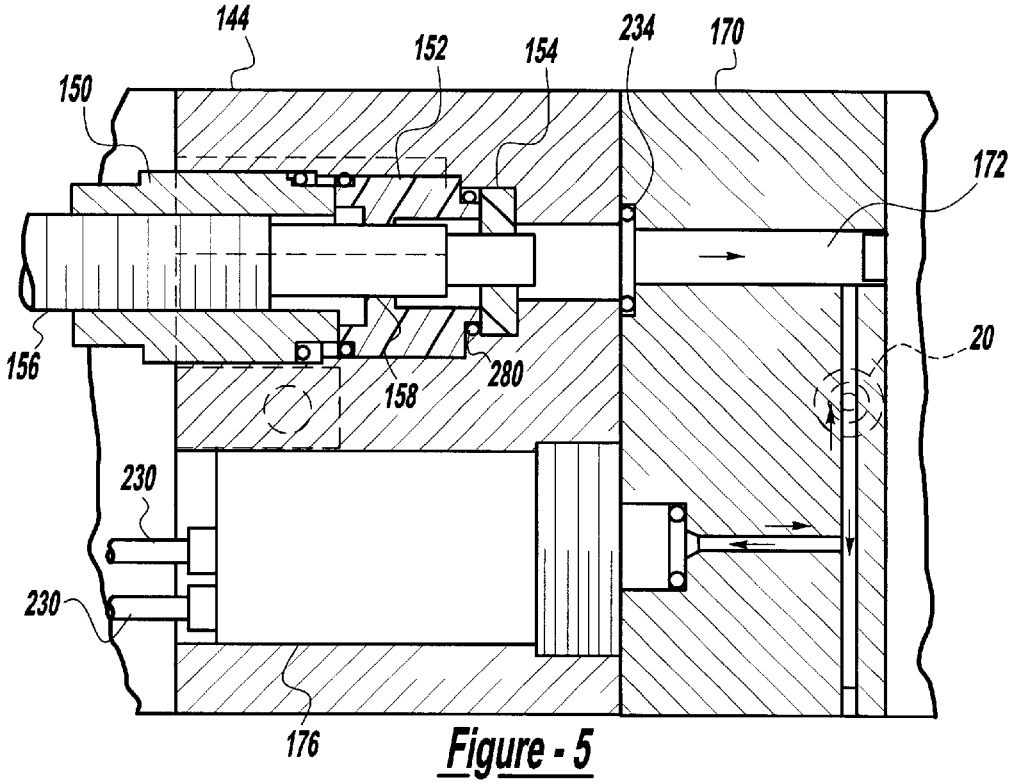
FIG. 5 is a fragmentary cross-sectional view of an activator block, a secondary block and a flow control assembly taken along line 5—5 of FIG. 4.
Figure 8:
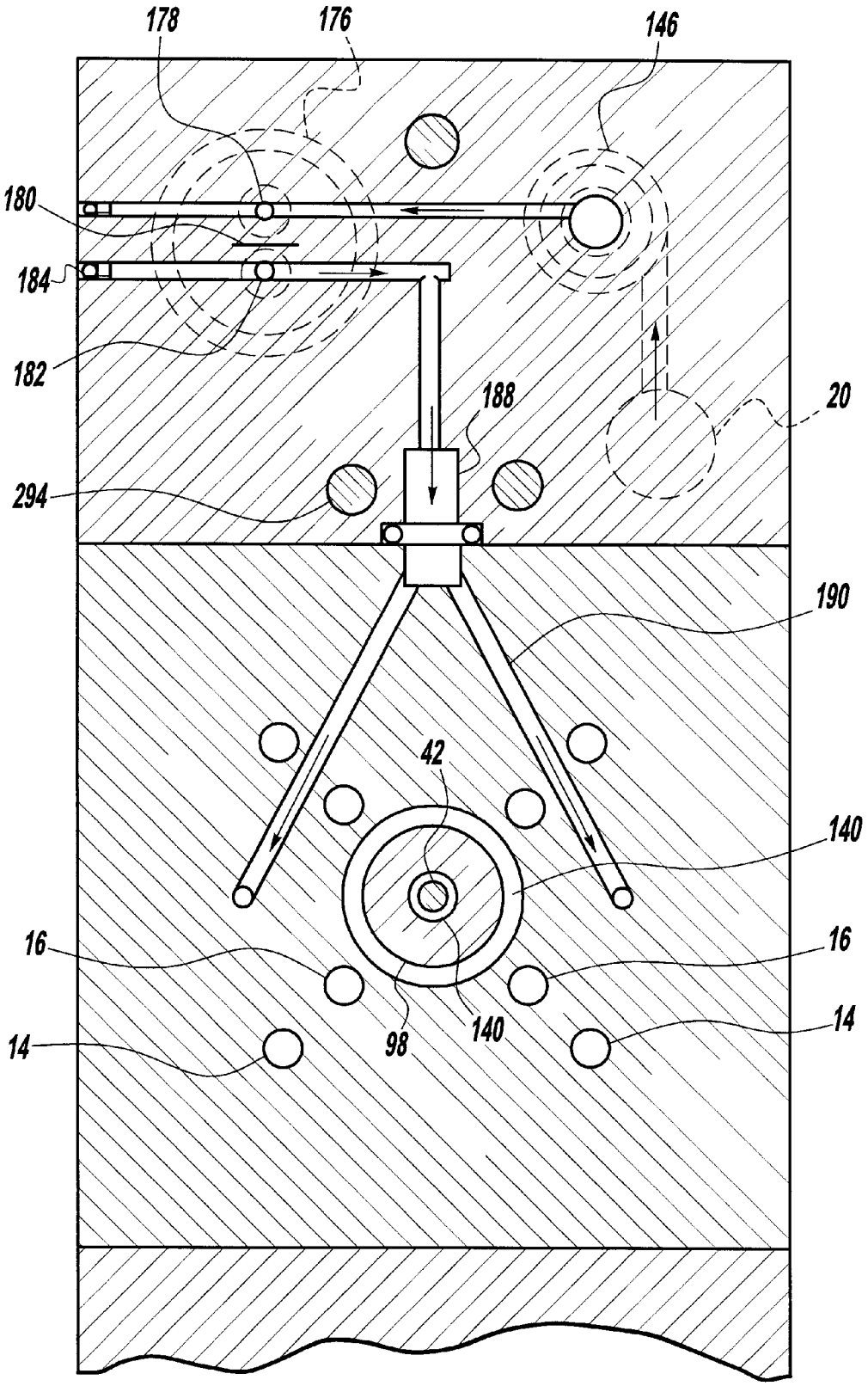
FIG. 8 is a fragmentary cross-sectional view the fluid spraying system of FIG. 1 taken along line 8—8 of FIG. 4.

Activator block 170 is mounted to secondary block 144 by a fastener (shown as threaded screws 284) fit through apertures 282. Activator block 170 is intended to provide for the flow of the activator to air cap assembly 64. Solenoid 176 is disposed between activator block 170 and secondary block 144. Electrical connectors (shown as wires 230) are connected to an electrical circuit (not shown) to independently regulate the amount of activator that flows to air cap assembly 64. Referring to FIGS. 5 and 8, activator block 170 includes inlet 178, seal 154 and solenoid 176. Solenoid 176 includes inlet 178 and outlet 182 separated by gate 180. Gate 180 acts as a valve and permits the activator to flow from inlet 178 to outlet 182. Gate 180 may include a diaphragm that is extended and retracted relative to a coil in response to a signal. (According to an alternative embodiment as shown in FIG. 8, a plug may be disposed within inlet 178 and outlet 182 to prevent the activator from leaking from activator fluid flow of circuit 20.) After being discharged from outlet 182, the activator flows through diverter 188. The activator flows from Y-shaped diverter 188 to threaded needle tubes 192 disposed at least partially within fan air passage 62 of wing 72.

Figures 3, 13:
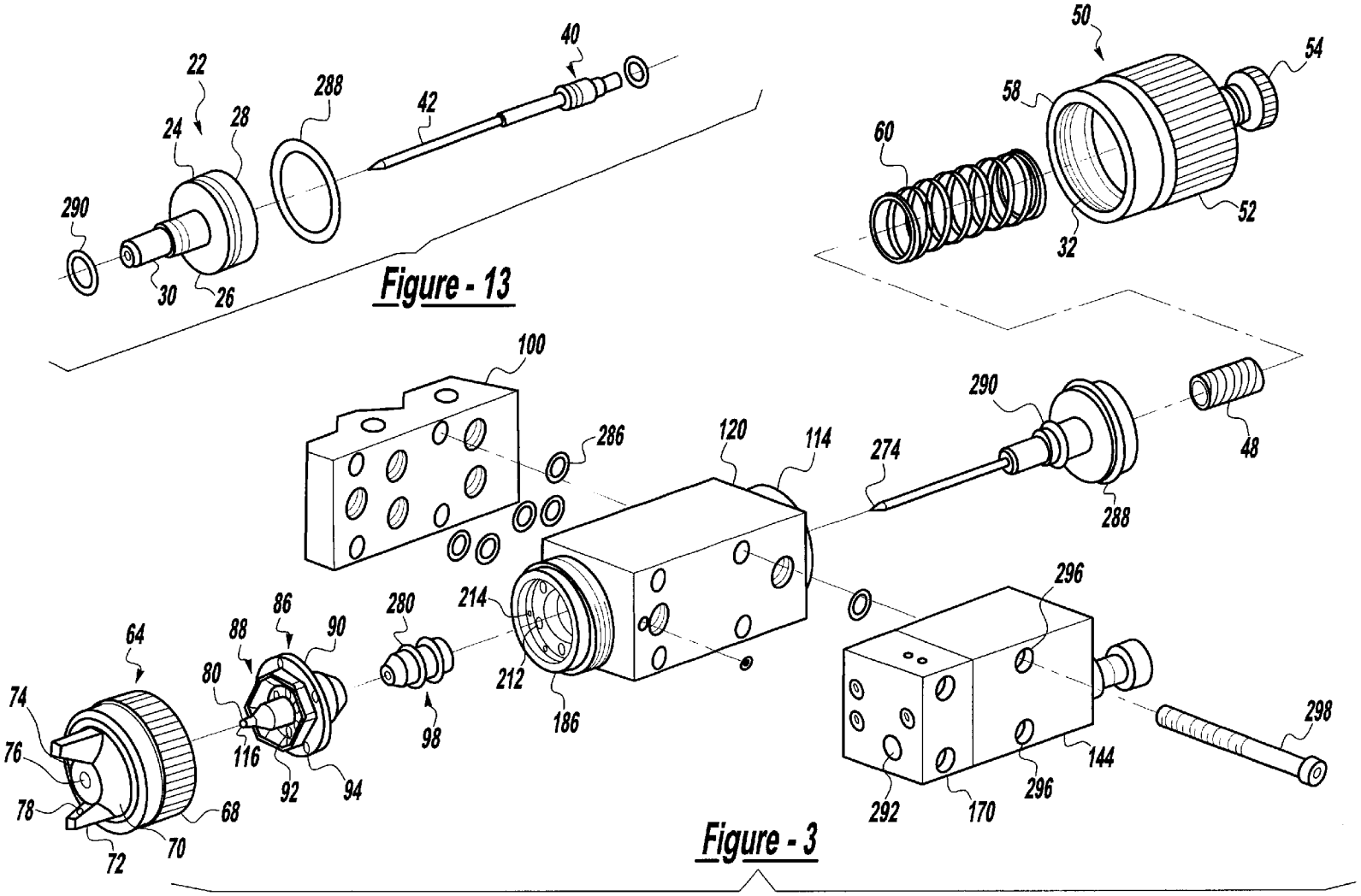
FIG. 3 is an exploded perspective view of the fluid spraying system of FIG. 1 according to an exemplary embodiment of the present invention.
FIG. 13 is an exploded perspective view of the piston assembly.

Nozzle assembly 86 assists in the distribution of the adhesive, atomization air and fan air to air cap assembly 64 (see FIG. 3). Cartridge 98 of nozzle assembly 86 cooperates with protrusion 30 of piston 24 to further guide needle 42 through central cavity 140. Cartridge 98 includes radial seals (shown as O-rings 280) to inhibit the adhesive from flowing into spring chamber 34. Radial ports 92 of nozzle 88 distribute atomization air from ports 212 of protruding ring 186 to air cap assembly 64, and radial ports 94 of nozzle 88 distribute fan air from ports 214 of protruding ring 186 to air cap assembly 64. A fluid tip 80 having central orifice 116 extends from distribution ring 90. A terminal end 274 of needle 42 is configured to selectively block central orifice 116 of fluid tip 80. In operation of needle assembly 40, when needle 42 is retracted towards adjustment screw 54 the adhesive is permitted to flow through central orifice 116 of fluid tip 80. When needle 42 is extended toward air cap assembly 64, terminal end 274 of needle 42 blocks central orifice 116 such that the adhesive is inhibited from escaping through central orifice 116.

Figure 9:
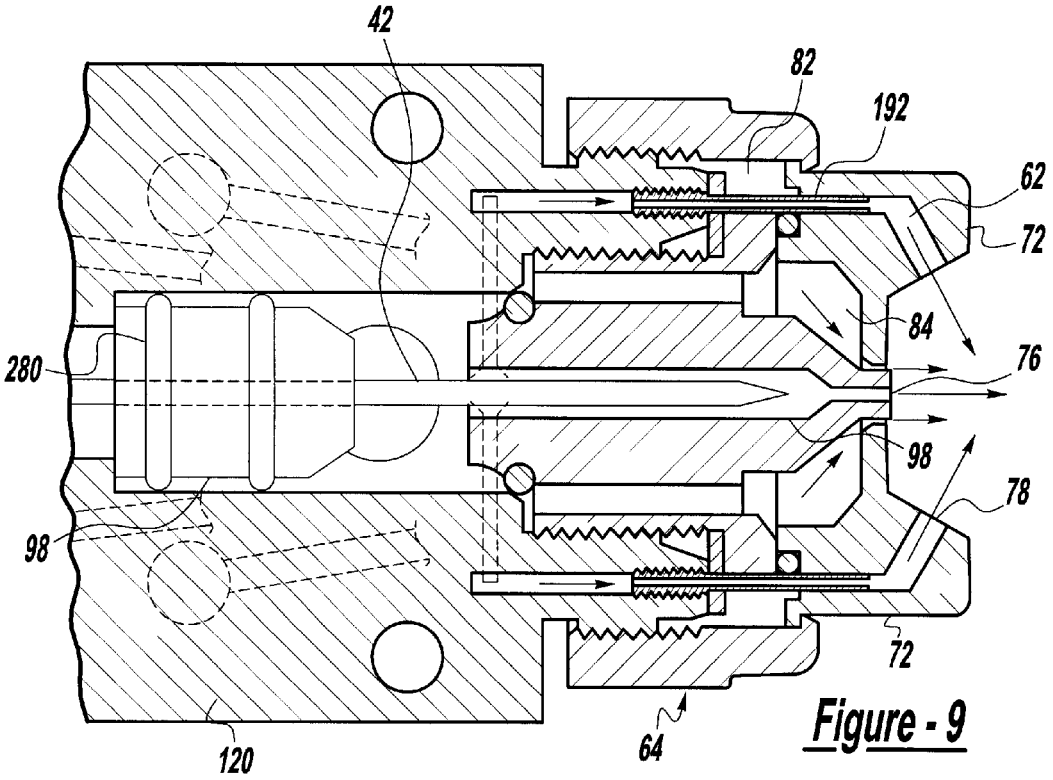
FIG. 9 is a fragmentary cross-sectional view of a body, a nozzle assembly and an air cap assembly of the fluid spraying system of FIG. 1 taken along line 9—9 of FIG. 4.

Air cap 70 is adapted to house nozzle 88. Retaining ring 68, which may be threaded, secures air cap 70 to protruding ring 186 of housing 120. According to an alternative embodiment as shown in FIG. 9, air cap assembly 64 may include needle tubes 192 in fluid communication with activator tube 190 to provide for the flow of the activator from activator block 170 to fan air chamber 82. Air cap assembly 64 also includes atomization air chamber 84. Atomization air that flows through central orifice 116 of fluid tip 80 then flows to atomization air chamber 84 and further flows through outlet 74 of air cap 70. The adhesive from central cavity 140 is discharged from air cap through outlet 76. According to any alternative or preferred embodiments as shown in the FIGURES, a seal (shown as an O-ring 278) may be disposed between nozzle 88 and retaining ring 68 to prevent atomization air and fan air from leaking out air cap assembly 64.

Figure 15:
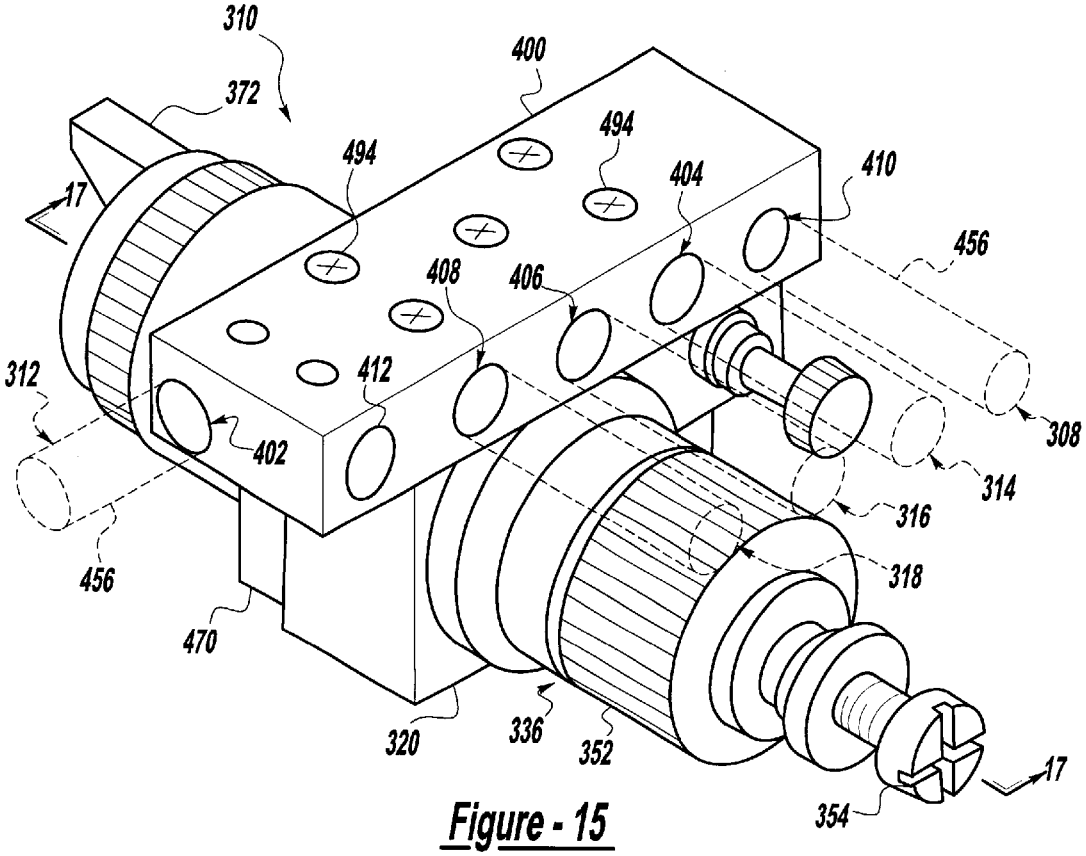
FIG. 15 is a fragmentary perspective view of a fluid spraying system according to an alternative embodiment of the present invention.

A fluid spraying system 310, an alternative embodiment of fluid spraying system 10, is shown in FIGS. 15–20. Referring to FIG. 15, system 310 includes a fluid distribution block or manifold (shown as a plenum 400) mounted to a housing 320 by fasteners (shown is threaded screws 498) fit through apertures 496. An internal body (shown as a barrel 344) is disposed within and extends through housing 320. An end cap assembly 336 is threadedly mounted to an intake end 346 of barrel 344, and an air cap assembly 364 (at least partially surrounding a nozzle assembly 386) is threadedly connected to a discharge end 348 of barrel 344. System 310 is intended to provide for the routing or flow of adhesive, atomization air, activator, fan air and cylinder air through an adhesive fluid circuit 312, an atomization air fluid circuit 316, an activator fluid circuit 308, a fan air fluid circuit 314 and a cylinder air fluid circuit 318, respectively. The fluid circuits of system 310 are similar to the fluid circuits of system 10. For example, the fluid circuits of system 310 are generally co-axial and include few harsh angles, which improves fluid flow by decreasing resistance and friction against the walls of each fluid circuit. Also, the simple construction of system 310 is intended to reduce its total weight by using space more efficiently. Such simple construction is intended to provide for rapid maintenance, servicing, repair, etc. and reduce the likelihood of potential leaks in the fluid circuits.

End cap assembly 336 of system 310 includes an end cap 352 defining and an end cap chamber 332. An adjustment screw 354 is threadedly connected to end cap 352 to variably compress and decompress a piston spring 360 and a needle spring 504. A piston assembly 322 is disposed within end cap chamber 332. Piston assembly 322 includes a piston 324 having a top surface 326 and a bottom surface 328. A protruding member 330 extends from top surface 326 of piston 324 and provides support to a needle 342 of a needle assembly 340. In operation of piston assembly 322 and needle assembly 340, the cylinder air is forced against top surface 326 of piston 324, which causes piston 324 to compress piston spring 360. As result, needle 342 is retracted towards adjustment screw 354 so that adhesive may flow through a central orifice 440 of housing 320 (and externally relative to air cap assembly 364) through an outlet 376. When piston returns or is extended toward air cap assembly 364, needle 342 blocks outlet 376 such that the adhesive is inhibited from being discharged from outlet 376. Piston spring 360 and needle spring 504 allow needle assembly 340 to extend and retract at a rapid rate of speed, which in turn allows the adhesive to variably be sprayed out of outlet 376 and is intended to reduce clogging. According to any preferred or alternative embodiment shown in the FIGURES, seals (shown as O-rings 502) may be disposed around piston assembly 322 and needle assembly 340 to inhibit the cylinder air and the adhesive from leaking into a piston spring chamber 334 of end cap chamber 332.

A cylinder nut 420 is threadedly mounted to end cap 352. Cylinder nut 420 includes a radial flange 422 having orifices 442 for cylinder air. A circular-shaped protruding member 416, which may be threaded, extends from flange 422. Protruding member 416 fits within an aperture 434 of a cylinder washer 430. (The diameter of aperture 434 is greater than be diameter of protruding member 416.) Cylinder washer 430 includes orifices 432 for the cylinder air. A seal (shown as an O-ring 506) may be disposed between cylinder washer 430 and housing 320.

Plenum 400 is mounted to housing 320 by a fastener (shown as a threaded screw 494) fit through an aperture 484. Plenum 400 includes an activator intake 410, a fan air intake 404, an atomization air intake 406, a cylinder air intake 408 and an adhesive intake 402 for connecting each respective source (not shown) by tubes 456. Intakes 404, 406, 408 and 410 are generally co-axial with each other (adhesive intake 402 is shown disposed generally transverse to intakes 404, 406, 408 and 410). The mounting of tubes 456 to plenum 400 is intended to provide for monitoring or metering of the flow pressure of the fluids through each respective fluid circuit. A mounting hole 412 drilled, bored, molded, etc. in plenum 400 is intended to provide a mounting point for attaching a handle and/or trigger assembly (not shown) to system 310. Housing 320 also includes a flow control assembly 446 similar to activator flow control assembly 146, to regulate the amount of activator that is discharged through activator fluid circuit 308. A circular recess 338 of housing 320 is configured to receive barrel 344.

Figure 16:
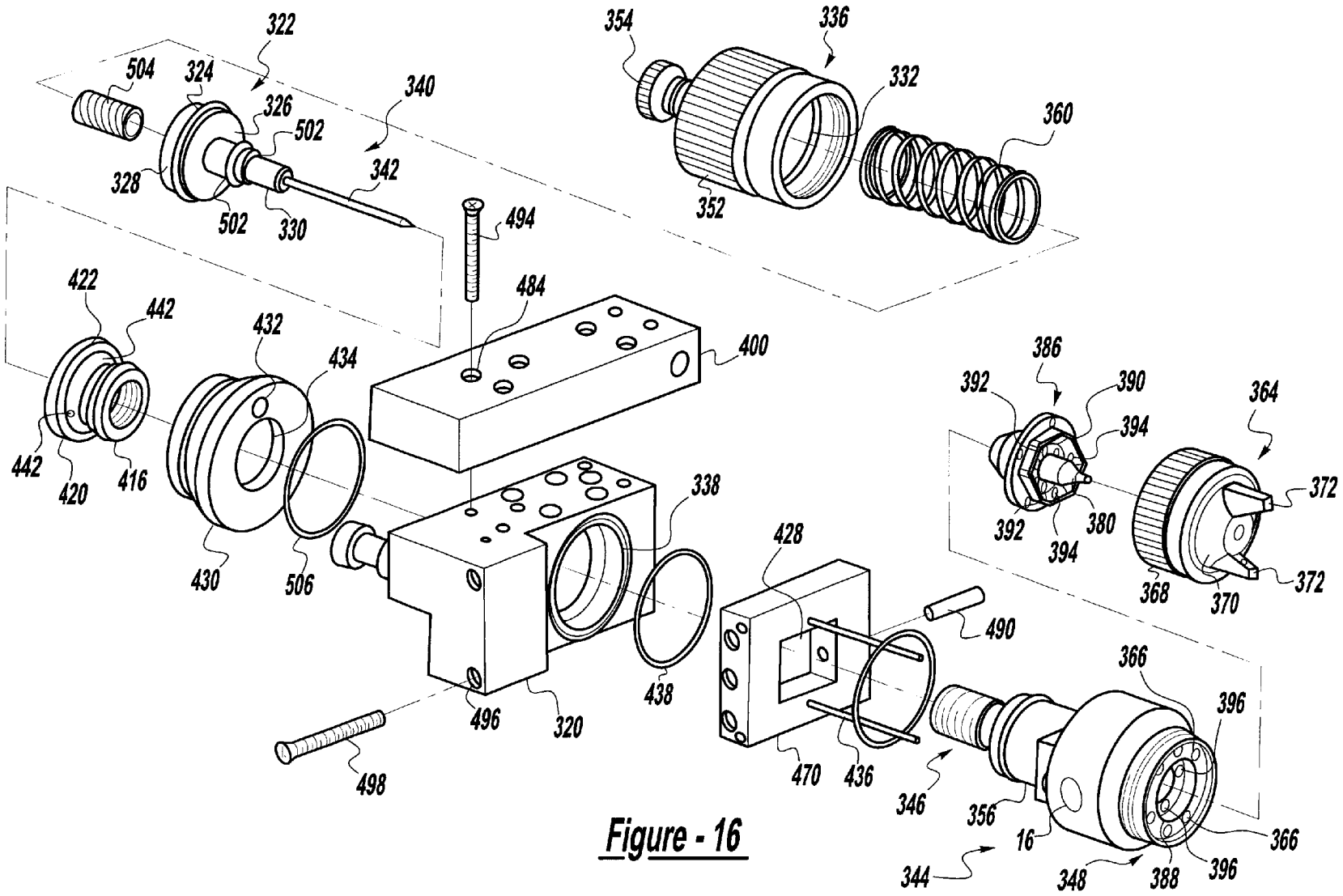
FIG. 16 is an exploded perspective view of the fluid spraying system of FIG. 15.

An activator block 470 is connected to housing 320 by threaded screws 498 fit through apertures 496. Activator block 470 is generally square-shaped and includes a generally square-shaped aperture 428. In operation of fluid spraying system 310, flow control assembly 446 includes a screw 448 that regulates the amount of the activator that flows through an activator channel 472 to an inlet 478 of a solenoid 476. A gate 482 disposed between inlet 478 and an outlet 480 of solenoid 476 regulates the quantity of activator that passes from inlet 478 to outlet 480. After passing through outlet 480 of solenoid 476, activator then flows through an activator passage 486 to a diverter 488 disposed in housing 320. Diverter 488 is intended to provide for the flow of activator to an activator port 490. Needle tubes 492 are threadedly connected to activator port 490 and disposed at least partially within a fan air chamber 382 of air cap assembly 364. According to an alternative embodiment as shown in FIG. 16, a seal (shown as O-ring 438) may be disposed between activator block 470 and housing 320.

Figure 18:
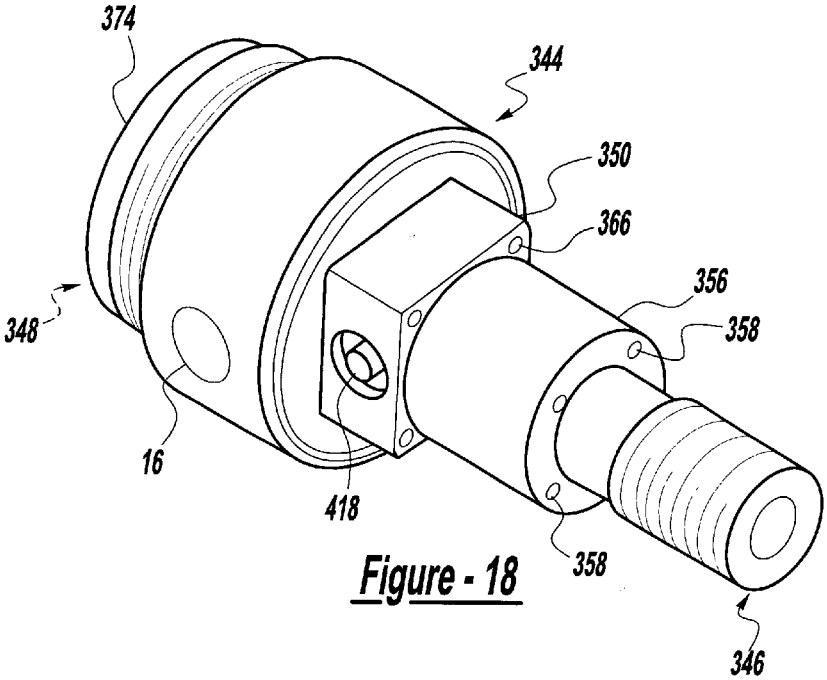
FIG. 18 is a perspective view of a barrel of the fluid spraying system of FIG. 15.

Barrel 344 includes a generally square-shaped bridge 350 that is configured to fit within aperture 428 of activator block 470 (see FIG. 18). Bridge 350 includes a port 418 for receiving the activator from port 490. Bridge 350 also includes radial orifices 366 for fan air such that fan air may flow through orifices 432 to orifices 366. A cylinder 356 having a perimeter less than the perimeter of bridge 350 includes radial orifices 358 for atomization air, such that atomization air may pass from orifices 442 to orifices 358. Cylinder 356 is shaped so that it may fit within circular recess 338 of housing 320. A threaded ring 374 of barrel 344 fits through aperture 434 of cylinder washer 430 and is threadedly connected to protruding member 416 such that barrel 344, activator block 470, housing 320, cylinder washer 430 and cylinder nut 420 may be secured together in the axial direction as a single unit. Discharge end 348 of barrel 344 includes radial orifices 396 for atomization air and orifices 366 for fan air.

A rear portion of nozzle assembly 386 is at least partially fit through a circular recess 388 of barrel 344, and a front portion of nozzle assembly 386 is disposed at least partially within air cap assembly 364. A distribution ring 390 of nozzle assembly 386 includes interior orifices 392 for atomization air and exterior orifices 394 for the fan air. A fluid tip 380 extends from distribution ring 390. A retaining ring 368 of air cap assembly 364 is threadedly connected to discharge end 348 of barrel 344. Air cap assembly 364 includes an air cap 370 having wings 372. Fan air chamber 382 is disposed in wings 372.

Figure 17:
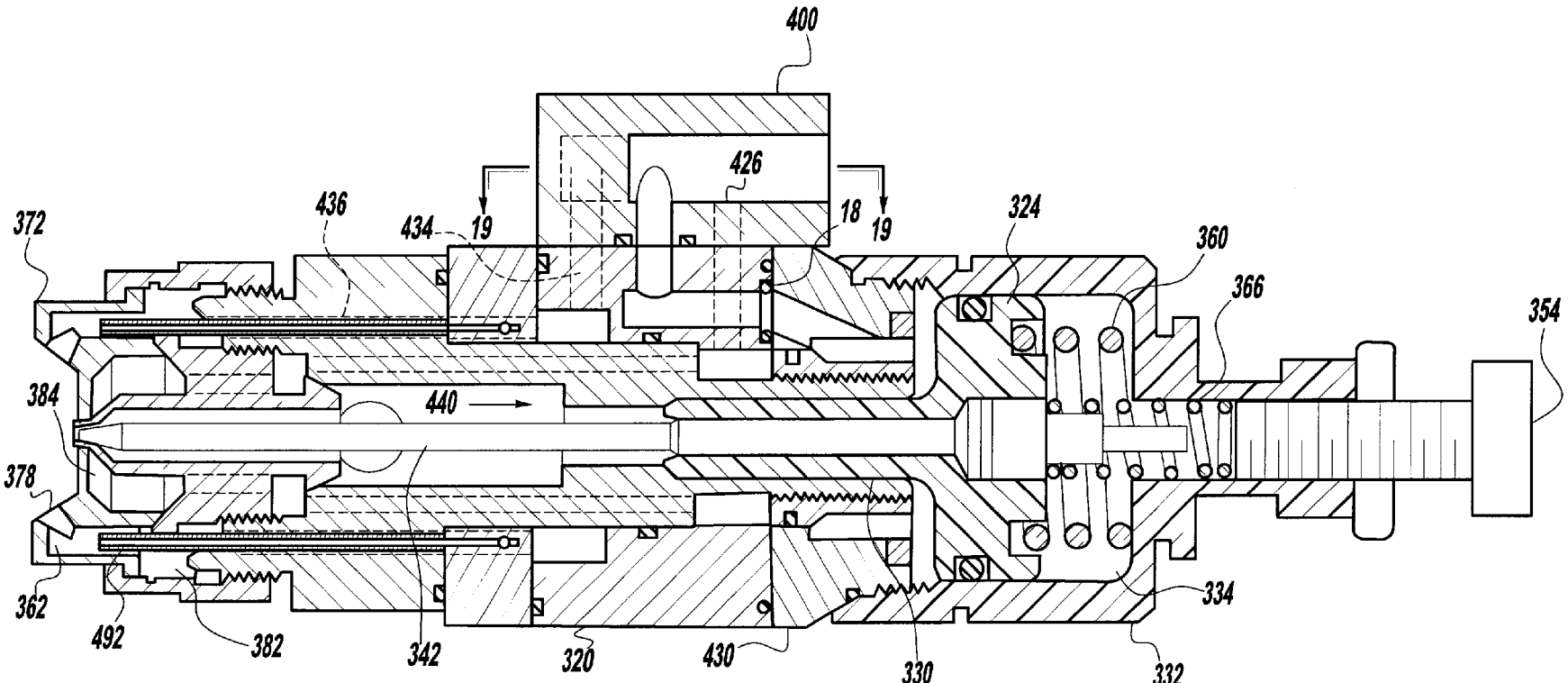
FIG. 17 is a cross-sectional view of the fluid spraying system of FIG. 15 taken along line 17—17 of FIG. 15.
Figure 19:
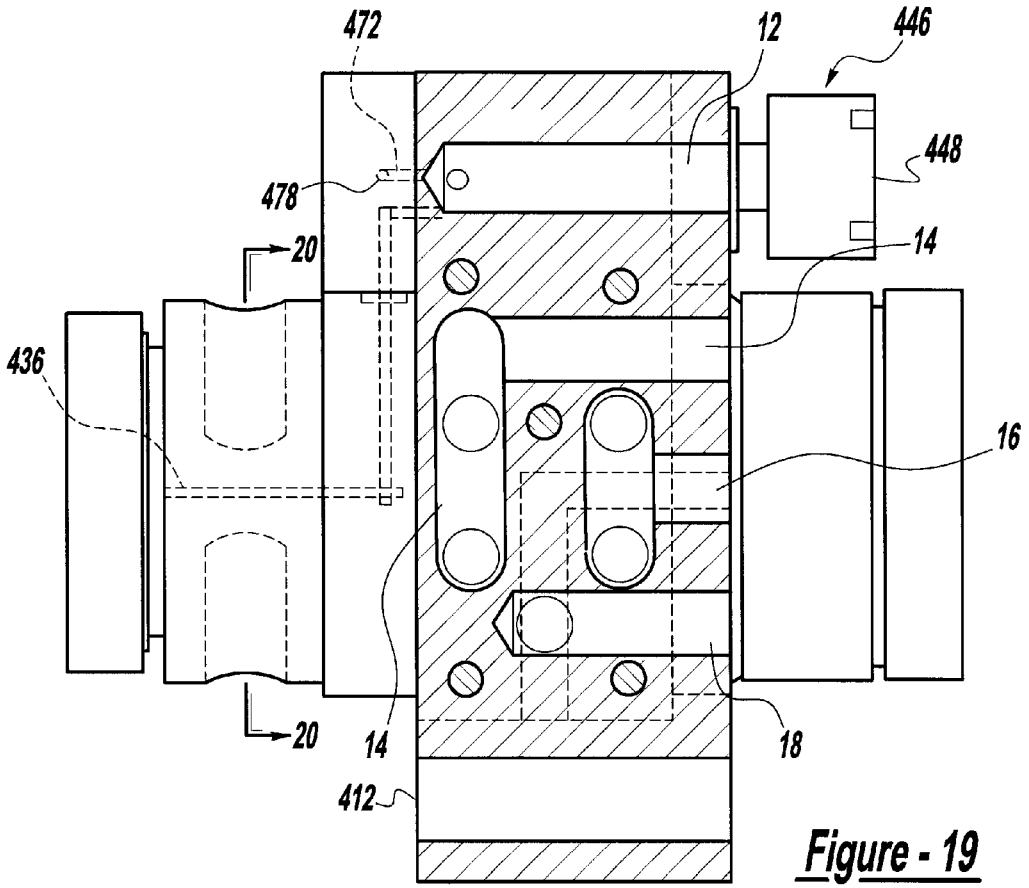
FIG. 19 is a fragmentary cross-sectional view of an air cap, the barrel and a fluid distribution block of the fluid spraying system of FIG. 15 taken along line 19—19 of FIG. 17.
Figure 20:
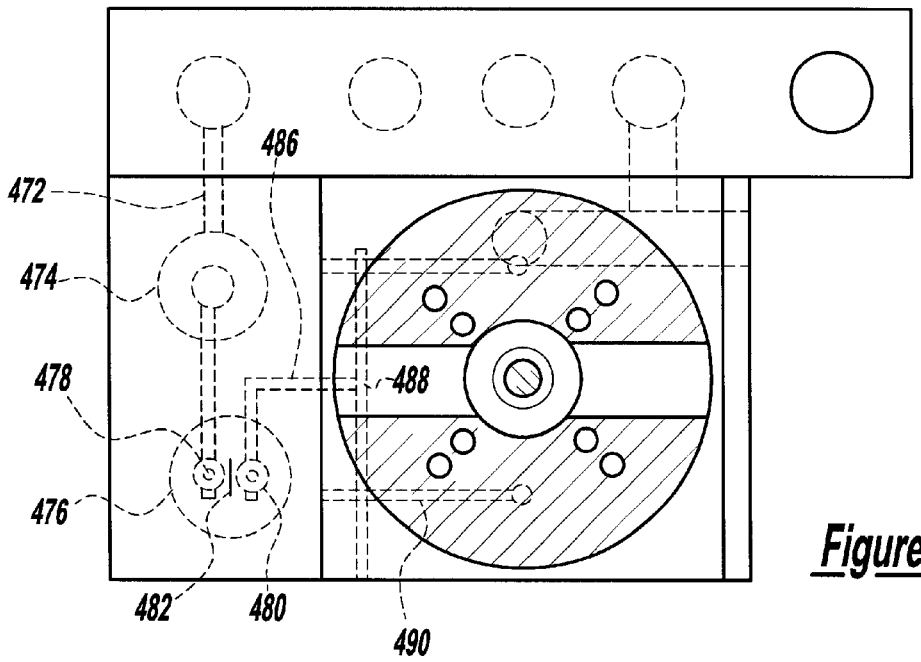
FIG. 20 is a cross-sectional view of the fluid spraying system of FIG. 15 taken along line 20—20 of FIG. 19.

Referring to FIGS. 17 and 19, the flow of each fluid circuit for each fluid (e.g., adhesive, the atomization air, activator, fan air and cylinder air) is shown. Adhesive flows from adhesive intake 402 of plenum 400 to central orifice 440 of housing 320. As needle 342 is retracted towards adjustment screw 354 adhesive is permitted to flow through fluid tip 380 and through outlet 376 of air cap 370. Atomization air flows from intake 406 of plenum 400 to a transverse atomization air conduit 426. From transverse atomization air conduit 426, the atomization air then flows through orifices 392 of distribution ring 390 and into an atomization air chamber 384 of air cap 370. The atomization air is then discharged externally from air cap 370 through outlet 376. The fan air flows from intake 404 of plenum 400 to a transverse fan air conduit 424. The fan air then travels through a horizontal fan air conduit 436 to a fan air passage 362 of air cap 370. The fan air then travels through air cap 370 and then through a discharge 378 of wings 372. Referring to FIG. 20, activator flows from activator intake 410 of plenum 400 to activator channel 472. The activator that passes through activator channel 472 then flows to solenoid 476, which regulates the amount of activator that flows through diverter 488 to needle tubes 492. Activator travels through needle tubes 492 to fan air chamber 382 and is discharged from air cap 370 through discharge 378 of wings 372. The atomization and spraying pattern of atomization air, adhesive, activator, and fan air are similar to that described above with respect to FIGS. 9 and 11–11B.

According to any alternative or preferred embodiments, a variety of adhesives may be used with the fluid spraying system. For example, a water-based adhesive wherein the atomization air and the fan air assist in breaking or separating the water from the adhesive may be employed, which may have environmental advantages over solvent-based adhesives. Other adhesives may include latex, neoprene, or acrylics. The adhesive may have a pH in the range from about 10–11 and in a wide range of viscosities. Water-in-oil emulsion adhesives having a tubular-shaped or cylindrical-shaped surfactant (i.e., resin) connecting the adhesive to water are particularly preferred, although hydroxyl group surfactants that separate the adhesive from water may also be used according to alternative embodiments. According to any alternative or preferred embodiments, the activator is acidic and may have a pH in the range of about 1–5, more preferably from about a pH of 1–3. For example, citric acid having a pH of about 1.5, zinc sulfide having a pH of about 3, or lactic acid having an acidic pH are all suitable activators. Also, the activator may be replaced by a cross-linking agent such as those cross-linking agents compatible with acrylics. The flow of the atomization air and the fan air through the respective fluid circuits may have a pressure from about 3–10 lbs./sq. inch to about 40 lbs./sq. inch (preferably from about 10–20 lbs./sq. inch.). According to a particularly preferred embodiment, the volume of the adhesive to the volume of the activator is at a ratio of about 15–25:1, more preferably at a ratio of about 18–22:1. According to a particularly preferred embodiment, the volume of activator fluid is varied until the resulting activated atomized adhesive fluid stream has a pH of about 6.8–7.0.

According to a particularly preferred embodiment, the flow of the adhesive through the adhesive fluid circuit is at a pressure of about 15 lbs./sq. in. The nozzle of the fluid spraying system is preferably spaced from the substrate at a distance of about 6–24 inches and is discharged from the nozzle at a rate of about 150 feet/minute. The pressure of the fan air is preferably about two times as great as the pressure of the atomization air when separating the water from the adhesive in an adhesive and water emulsion. The air cap assembly, the nozzle, the piston, the air cap, the housing and the needle assembly are commercially available from Kremlin Company of Stains, France. The solenoid and is commercially available from Lee Company of Westbrook, Conn. Preferably, the housing, the fluid distribution block, the activator block and the secondary block are constructed of Delrin® plastic, but may be constructed of metal according to alternative embodiments. The fasteners for connecting the plenum to the housing are preferably flat-headed machine screws, which are about 3 inches long and exposed about $\frac{7}{16}$ of an inch above the aperture. The O-rings are preferably constructed of Viton® rubber or Teflon® polymers and are generally impervious to acids and solvents. The piston assembly is preferably pneumatically controlled. The fan air outlet and the atomization air outlets are preferably of about equal sizes. Not wishing to be limited by theory, it is believed that the size of the outlet assists in about uniformly breaking the water apart from the adhesive in a water-based adhesive. The fan air outlet preferably has a diameter of about $\frac{1}{8}$ inch, the atomization air outlet has a diameter of about $\frac{1}{8}$ inch and the adhesive outlet has a diameter of about $\frac{60}{1000}$ inch.

It is important to note that the construction and arrangement of the elements of the fluid spraying system in the exemplary embodiments is illustrative only. Many variations are possible. According to alternative embodiments, any variety of fluids may be delivered, such as paints, adhesives, laminates, aerosols, coatings, insecticides, etc. The activator may be any type of product or catalyst that speeds up or completes a chemical reaction. According to other alternative embodiments, the fluid spraying system may include a wound polymer medium to remove particulate and water from the atomization air and the fan air. According to an alternative embodiment, the system may be employed as a one-part adhesive without the use of an activator, an activator block and/or a secondary block. The components of the fluid spraying system (e.g., housing, barrel, secondary block, fluid distribution block, etc.) may be constructed of plastic. The piston assembly may be controlled by any fast-acting mechanism such as a crank, a solenoid, a stepper, etc. According to an alternative embodiment, the fan air may flow from the fan air intake and through the orifice of the cylinder washer before entering the fan air passage. According to alternative embodiments, a variety of valves or fluid regulating devices or elements may be used such as check valves, ball valves, spigot controlled valves, solenoid valves, needle valves, pivot valves, etc. to regulate the flow of fluids through the fluid circuits. According to other exemplary embodiments, the fluid spraying system can be incorporated to be configured to be used with other conventional elements of a spray gun, or assembled from conventional or commercially available elements or assemblies of such conventional spray guns. According to an alternative embodiment, a fibrous filter media may be disposed around the nozzle to remove excess surfactant and water as it is discharged from the nozzle.

It is important to note that the terms "passage" is not meant as terms of limitation, insofar as the structures described in this specification (or alternative and/or equivalent structures) may serve to provide for the flow of a fluid through a channel, chamber, tube, conduit, inlet, intake, outlet, discharge, port, etc.

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, or use of materials) without materially departing from the novel teachings and advantages of the invention. Accordingly, all such modifications are intended to be included within the scope of the invention as defined in the appended claims. Other substitutions, modifications, changes and omissions may be made in the design, operating conditions and arrangement of the preferred embodiments without departing from the spirit of the invention as expressed in the appended claims. The order or sequence of steps, for example, of turning the fluid circuits "on" and "off" or turning the valves "on" or "off" may be varied or re-sequenced according to alternative embodiments of the invention. For example, the fan air may be turned "on" or "off" slightly before or after the atomization air is turned "on" or "off," and the activator may be turned "on" or "off" slightly before the adhesive is turned "on" or "off." In the claims, any means-plus-function clause is intended to cover the structures described herein as performing the recited function and not only structural equivalents but also equivalent structures.

What is claimed is:

1. A spraying system for delivering a plurality of fluids for applying to a surface, which comprises:

a nozzle assembly having a fluid tip;

a body with a central orifice and a set of orifices radially adjacent to the central orifice;

an air cap having a set of passages in communication with the set of orifices and a set of conduits contained at least partially within the set of passages;

a plurality of fluid circuits in communication with the nozzle assembly, one of the fluid circuits adapted to deliver an adhesive, one of the fluid circuits adapted to deliver an activator, one of the fluid circuits adapted to deliver atomization air, and one of the fluid circuits adapted to deliver fan air from the nozzle assembly; and a controller that can be switched to an active state upon which the fluid circuit for atomization air and the fluid circuit for fan air are opened, the fluid circuit for the activator is opened and then the fluid circuit for the adhesive is opened, and to an inactive state, upon which the fluid circuit for the adhesive and the fluid circuit for the activator are closed, and the fluid circuit for atomization air and the fluid circuit for fan air are closed;

wherein the adhesive is delivered in a generally axial direction through the central orifice in the body, atomization air to atomize the adhesive is delivered in a generally axial direction through the set of orifices in the body, fan air is delivered into the set of passages in the air cap and in a generally radial direction from the set of orifices in the air cap, and the activator is delivered into the set of passages in the air cap from the set of conduits at a point of introduction so that the activator is atomized by fan air within the set of passages in the air cap and delivered from the set of orifices of the air cap, wherein the conduits are co-linear with the set of passage at the point of introduction;

so that a fluid mixing area is provided outside the nozzle assembly in a space ahead of the orifices through which the adhesive and atomization air are delivered.

2. The spraying system of claim 1 wherein the fluid circuit for atomization air and the fluid circuit for fan air are opened essentially simultaneously during the active state.

3. The spraying system of claim 1 wherein the controller is an electronic controller configured so that each of the fluid circuits is under independent control regardless of the presence or flow to any other of the fluid circuits.

4. The spraying system of claim 1 wherein the set of conduits for the activator terminates within the air cap so that the activator is atomized by fan air prior to discharge from the air cap.

5. The spraying system of claim 1 wherein the adhesive is a water-based adhesive and the mixing area is configured to promote the atomization of the adhesive and mixing so that a pre-determined ratio of the adhesive and the activator is supplied to the substrate.

6. The spraying system of claim 1 wherein the delivery of the adhesive through the central orifice is controlled by a fast-acting needle valve that provides a very rapid transition from a fully-open state to a fully-closed state.

7. The spraying system of claim 1 wherein the fan air and the activator have fluid flows that are generally coaxial.

8. The spraying system of claim 7 wherein the activator is combined with the fan air within the set of passages so that the direction of a combined flow of fan air and activator is substantially parallel with the direction of flow of the separate fan air and activator.

9. The spraying system of claim 8 wherein the fluid flow of the fan air circumscribes the fluid flow of the activator flow.

10. The spraying system of claim 2 wherein the fluid circuit for the adhesive and the fluid circuit for the activator are closed essentially simultaneously during the inactive stage.

11. The spraying system of claim 1 wherein the conduits are tube-like.

12. The spraying system of claim 1 wherein the set of passages end with an outlet for discharging the fan air and the activator air.

13. The spraying system of claim 12 wherein the flow at the point of introduction has a first flow direction, and the flow at the outlet has a second flow direction which is different than the first flow direction.

14. The spraying system of claim 1 wherein the direction of flow of the activator before the point of introduction is generally parallel to both the direction of flow of the fan air before the point of introduction and the direction of flow of the activator after the point of introduction.

15. A spraying system for delivering a plurality of fluids for applying to a substrate in a work environment, which comprises:

a housing having a central orifice, a set of fan air orifices, and a set of atomization air orifices, the fan air orifices and the atomization air orifices being radially adjacent to the central orifice;

a nozzle assembly for distribution of adhesive through a fluid tip, atomization air through a plurality of central orifices, and fan air through orifices of a distribution ring, the orifices of the distribution ring being radially adjacent to the central orifice;

an air cap assembly having a set of passages in communication with the orifices and a set of conduits contained at least partially within the set of passages;

a plurality of fluid circuits in communication with the nozzle assembly, one of the fluid circuits adapted to deliver an adhesive, one of the fluid circuits adapted to deliver an activator, one of the fluid circuits adapted to deliver atomization air, and one of the fluid circuits adapted to deliver fan air from the nozzle assembly to the air cap assembly; and a controller that can be switched to an active state upon which the fluid circuit for atomization air and the fluid circuit for fan air are opened, the fluid circuit for the activator is opened and then the fluid circuit for the adhesive is opened, and to an inactive state, upon which the fluid circuit for the adhesive and the fluid circuit for the activator are closed, and the fluid circuit for atomization air and the fluid circuit for fan air are closed;

wherein the adhesive is delivered in a generally axial direction through the central orifice in the body, atomization air to atomize the adhesive is delivered in a generally axial direction through the set of orifices in the housing, fan air is delivered into the set of passages in the air cap and in a generally radial direction from the set of orifices in the air cap, and the activator is delivered into the set of passages in the air cap from the set of conduits at a point of introduction so that the activator is atomized by fan air within the set of passages in the air cap and delivered from the set of orifices of the air cap, wherein the conduits are substantially parallel to the direction of the flow of fan air;

so that a fluid mixing area is provided outside the nozzle assembly in a space ahead of the orifices through which the adhesive and atomization air are delivered.

16. The spraying system of claim 15, wherein a switch is provided to switch the controller to the active state and to the inactive state.

17. The spraying system of claim 15, further comprising an activator flow control system for regulating the flow of activator in the activator circuit including a threaded screw having a groove disposed at the terminal end.

18. The spraying system of claim 15, wherein the controller is an electronic controller configured so that each of the fluid circuits is under independent control regardless of the presence or flow to any other of the fluid circuits.

19. The spraying system of claim 15, wherein the set of conduits for the activator terminates within the air cap so that the activator is atomized by fan air prior to discharge from the air cap.

20. The spraying system of claim 15, wherein the housing is constructed of plastic.

21. The spraying system of claim 15, wherein the adhesive is a water-based adhesive and the mixing area is configured to promote the atomization of the adhesive and mixing so that a predetermined ratio of the adhesive and the activator is supplied to the substrate.

22. The spraying system of claim 15, wherein the delivery of the adhesive through the central orifice is controlled by a fast-acting needle valve that provides a very rapid transition from a fully-open state to a fully-closed state.

23. A spraying system for delivering a plurality of fluids for applying to a substrate to be coated in a work environment, the spraying system including a housing having a central orifice for a first fluid and fluid orifices for a first distribution fluid and fluid orifices for a second distribution fluid orifices for distribution of a second fluid, a nozzle assembly for distributing the first fluid through a fluid tip orifice, the first distribution fluid through a plurality of orifices and the second distribution fluid through a plurality of orifices, an air cap having a set of passages in communication with the orifices, and a plurality of fluid circuits for the flow of the first fluid, the second fluid, the first distribution fluid and the second distribution fluid, the fluid circuits being in communication with the nozzle assembly, so that the first fluid is delivered in a generally axial direction through the central orifice of the body, the first distribution fluid is delivered in a generally axial direction through the set of orifices in the housing and into the set of passages in the air cap and in a generally radial direction from the orifices in the air cap, and the second fluid is delivered in the passages in the air cap, wherein the improvement comprises:

a first mixing area for mixing the first fluid and the first distribution fluid being externally to the fluid tip orifice, and a second mixing area for co-linearly mixing the second fluid and the second distribution fluid being in the set of passages in the air cap.

24. The fluid spraying system of claim 23, wherein the first fluid is an adhesive, the second fluid is a catalyst, the first distribution fluid is atomization air and the second distribution fluid is fan air.

25. A method for controlling the fluid circuits in a spraying system having:

a housing having a central orifice and a set of fan air orifices and a set of atomization air orifices, the fan air orifices and the atomization air orifices being radially adjacent to the central orifice;

a nozzle assembly for distributing adhesive through a fluid tip, atomization air through a plurality of central orifices and fan air through orifices of a distribution ring, the orifices of the distribution ring being radially adjacent to the central orifice;

an air cap having a set of passages in communication with the orifices and a set of conduits contained at least partially within a set of passages, the nozzle assembly being at least partially disposed within the air cap; and a plurality of fluid circuits in communication with the nozzle assembly, one of the fluid circuits adapted to deliver an adhesive, one of the fluid circuits adapted to deliver an activator, one of the fluid circuits adapted to deliver atomization air, and one of the fluid circuits adapted to deliver fan air from the nozzle assembly to the air cap assembly;

wherein the adhesive is delivered in a generally axial direction through the central orifice in the body, atomization air to atomize the adhesive is delivered in a generally axial direction through the set of orifices in the housing, fan air is delivered into the set of passages in the air cap and in a generally radial direction from the set of orifices in the air cap, and the activator is delivered into the set of passages in the air cap from the set of conduits so that the activator is atomized by fan air within the set of passages in the air cap and delivered from the set of orifices of the air cap;

so that a fluid mixing area is provided outside the nozzle assembly in a space ahead of the orifices through which the adhesive and atomization air are delivered;

the method comprising:

switching a controller to an active state upon which the fluid circuit for atomization air and the fluid circuit for fan air are opened, then;

opening the fluid circuit for the activator and opening the fluid circuit for the adhesive essentially simultaneously, then;

spraying activated adhesive on a substrate, then;

switching the controller to an inactive state upon which the fluid circuit for the adhesive and the fluid circuit for the activator are closed, then;

purging the system with fan air and atomization air, then; and closing the fluid circuit for atomization air and the fluid circuit for fan air essentially simultaneously.

26. The method of claim 23, wherein opening the fluid circuit for the adhesive further includes opening a fluid circuit for cylinder air and switching the controller to an inactive state upon which the fluid circuit for the adhesive fluid circuit is closed further includes closing the fluid circuit for the cylinder air.

27. The method of claim 23, wherein switching the controller to an active state further includes purging the system with fan air and atomization air.

28. The method of claim 25, wherein purging the system with fan air and atomization air further includes controlling the purge with a timer.

29. A spraying system for delivering a plurality of fluids for applying to a substrate in a work environment, which comprises:

a housing having a central orifice, a set of fan air orifices, and a set of atomization air orifices, the fan air orifices and the atomization air orifices being radially adjacent to the central orifice;

a nozzle assembly for distribution of adhesive through a fluid tip, atomization air through a plurality of central orifices, and fan air through orifices of a distribution ring, the orifices of the distribution ring being radially adjacent to the central orifice;

an air cap assembly having a set of passages in communication with the orifices and a set of conduits contained at least partially within the set of passages, the nozzle assembly being at least partially disposed within the air cap;

a plurality of fluid circuits in communication with the nozzle assembly, one of the fluid circuits adapted to deliver an adhesive, one of the fluid circuits adapted to deliver an activator, one of the fluid circuits adapted to deliver atomization air, and one of the fluid circuits adapted to deliver fan air from the nozzle assembly to the air cap assembly;

a controller that can be switched to an active state upon which the fluid circuit for atomization air and the fluid circuit for fan air are opened, the fluid circuit for the activator is opened and then the fluid circuit for the adhesive is opened, and to an inactive state, upon which the fluid circuit for the adhesive and the fluid circuit for the activator are closed, and the fluid circuit for atomization air and the fluid circuit for fan air are closed; and a plenum for distributing the adhesive fluid circuit, the atomization air fluid circuit, the fan air fluid circuit and the activator fluid circuit;

wherein the adhesive is delivered in a generally axial direction through the central orifice in the body, atomization air to atomize the adhesive is delivered in a generally axial direction through the set of orifices in the housing, fan air is delivered into the set of passages in the air cap and in a generally radial direction from the set of orifices in the air cap, and the activator is delivered into the set of passages in the air cap from the set of conduits so that the activator is atomized by fan air within the set of passages in the air cap and delivered from the set of orifices of the air cap;

so that a fluid mixing area is provided outside the nozzle assembly in a space ahead of the orifices through which the adhesive and atomization air are delivered.

30. A spraying system for delivering a plurality of fluids for applying to a substrate in a work environment, which comprises:

a housing having a central orifice, a set of fan air orifices, and a set of atomization air orifices, the fan air orifices and the atomization air orifices being radially adjacent to the central orifice;

a nozzle assembly for distribution of adhesive through a fluid tip, atomization air through a plurality of central orifices, and fan air through orifices of a distribution ring, the orifices of the distribution ring being radially adjacent to the central orifice;

an air cap assembly having a set of passages in communication with the orifices and a set of conduits contained at least partially within the set of passages, the nozzle assembly being at least partially disposed within the air cap;

a plurality of fluid circuits in communication with the nozzle assembly, one of the fluid circuits adapted to deliver an adhesive, one of the fluid circuits adapted to deliver an activator, one of the fluid circuits adapted to deliver atomization air, and one of the fluid circuits adapted to deliver fan air from the nozzle assembly to the air cap assembly;

a controller that can be switched to an active state upon which the fluid circuit for atomization air and the fluid circuit for fan air are opened, the fluid circuit for the activator is opened and then the fluid circuit for the adhesive is opened, and to an inactive state, upon which the fluid circuit for the adhesive and the fluid circuit for the activator are closed, and the fluid circuit for atomization air and the fluid circuit for fan air are closed; and a barrel for storing the adhesive having a discharge end, a medial portion and an intake and, the air cap assembly coupled to a discharge end, an activator block coupled to a medial portion and a cylinder nut and a cylinder washer coupled to the intake end to form a single unit;

wherein the adhesive is delivered in a generally axial direction through the central orifice in the body, atomization air to atomize the adhesive is delivered in a generally axial direction through the set of orifices in the housing, fan air is delivered into the set of passages in the air cap and in a generally radial direction from the set of orifices in the air cap, and the activator is delivered into the set of passages in the air cap from the set of conduits so that the activator is atomized by fan air within the set of passages in the air cap and delivered from the set of orifices of the air cap;

so that a fluid mixing area is provided outside the nozzle assembly in a space ahead of the orifices through which the adhesive and atomization air are delivered.

31. A method for controlling the fluid circuits in a spraying system for delivering a plurality of fluids for applying to a substrate, the method including:

switching an electronic controller to an active state upon which a fluid circuit for atomization air and a fluid circuit for fan air are opened, then;

opening a fluid circuit for an activator and opening a fluid circuit for an adhesive, then;

activating the adhesive with the activator, then;

spraying the activated adhesive on a surface, then;

switching the electronic controller to an inactive state upon which the fluid circuit for the adhesive and the fluid circuit for the activator are closed, then;

purging the system with fan air and atomization air, then; and closing the fluid circuit for the atomization air and the fluid circuit for the fan air.

32. A spraying system for delivering a plurality of fluids for applying to a substrate to be coated in a work environment, the spraying system including a housing having a central orifice for a first fluid and fluid orifices for a first distribution fluid and fluid orifices for a second distribution fluid orifices for distribution of a second fluid, a nozzle assembly for distributing the first fluid through a fluid tip orifice, the first distribution fluid through a plurality of orifices and the second distribution fluid through a plurality of orifices, an air cap having a set of passages in communication with the orifices, and a plurality of fluid circuits for the flow of the first fluid, the second fluid, the first distribution fluid and the second distribution fluid, the fluid circuits being in communication with the nozzle assembly, so that the first fluid is delivered in a generally axial direction through the central orifice of the body, the first distribution fluid is delivered in a generally axial direction through the set of orifices in the housing and into the set of passages in the air cap and in a generally radial direction from the orifices in the air cap, and the second fluid is delivered in the passages in the air cap, wherein the improvement comprises:

a controller coupled to the first fluid, the second fluid, the first distribution fluid, and the second distribution fluid; and a switch configured to turn the controller on and off;

a plenum for distributing the first fluid, the second fluid, the first distribution fluid, and the second distribution fluid.

33. A spraying system for delivering a plurality of fluids to a surface, which comprises:

a body with a plurality of orifices;

a nozzle assembly coupled to the body;

a plurality of fluid circuits in communication with the nozzle assembly, including an adhesive fluid circuit adapted to deliver adhesive, an activator fluid circuit adapted to deliver activator, an atomization air fluid circuit adapted to deliver atomization air, and a fan air fluid circuit adapted to deliver fan air;

a plenum for distributing the adhesive fluid circuit, the atomization air fluid circuit, the fan air fluid circuit and the activator fluid circuit; and an electronic control system configured to provide independent control of each of the plurality fluid circuits.

34. The spraying system of claim 33 wherein the electronic control system includes a controller.

35. The spraying system of claim 34 wherein the controller is a programmable logic controller configured to implement a control program to provide output signals based on input signals.

36. The spraying system of claim 34 wherein the control system includes an input device coupled to the controller.

37. The spraying system of claim 36 wherein the input device is one of a trigger, touch-pad, keyboard, keypad, and sensors.

38. The spraying system of claim 33 wherein the control system includes information instrumentation.

39. The spraying system of claim 38 wherein the information instrumentation is one of a display screen, gauges, monitors, touch-pad, and user interface.

40. The spraying system of claim 33 wherein the sequence comprises turing the fan air and atomization air on, then after a preselected period to time turning the activator and adhesive on essentially simultaneously, then turning the activator and adhesive on essentially simultaneously, then after a preselected period to time turning the fan air and atomization air off.

41. The spraying system of claim 33 the activator is a catalyst.

42. A spraying system for delivering a plurality of fluids to a surface, which comprises:

a body with a plurality of orifices;

a nozzle assembly coupled to the body;

an air cap having a set of passages in communication with the set of orifices and a set of conduits contained at least partially within the set of passages and terminating at an outlet; and a plurality of fluid circuits in communication with the nozzle assembly, one of the fluid circuits adapted to deliver an adhesive, one of the fluid circuits adapted to deliver an activator, one of the fluid circuits adapted to deliver atomization air, and one of the fluid circuits adapted to deliver fan air from the nozzle assembly;

wherein the activator is delivered into the set of passages in the air cap from the set of conduits at a point of introduction so that the activator is atomized by fan air within the set of passages in the air cap and delivered from the set of orifices of the air cap, wherein the conduits are co-linear with the passages at the point of introduction;

so that the introduction of the activator into the passages allows for mixing of the fan air with the activator fluid prior to the discharge through the outlet.

43. The spraying system of claim 42 further including an electronic controller configured so that each of the fluid circuits is under independent control regardless of the presence or flow to any other of the fluid circuits.

* * * * *